US011722822B2

(12) United States Patent
Grimanis

(10) Patent No.: US 11,722,822 B2
(45) Date of Patent: Aug. 8, 2023

(54) AUDIO FEEDBACK DETECTION AND SUPPRESSION

(71) Applicant: Tymphany Acoustic Technology Limited, Taipei (TW)

(72) Inventor: Dimitrios Grimanis, Taipei (TW)

(73) Assignee: TYMPHIANY ACOUSTIC TECHNOLOGY LIMITED, Taipei (TW)

( * ) Notice: Subject to any disclaimer, the term of this patent is extended or adjusted under 35 U.S.C. 154(b) by 119 days.

(21) Appl. No.: 17/173,777

(22) Filed: Feb. 11, 2021

(65) Prior Publication Data

US 2021/0250691 A1 Aug. 12, 2021

Related U.S. Application Data

(60) Provisional application No. 62/972,894, filed on Feb. 11, 2020.

(51) Int. Cl.

| | |
|---|---|
| ***H04R 5/04*** | (2006.01) |
| ***H04R 3/12*** | (2006.01) |
| ***G10L 21/0216*** | (2013.01) |

(52) U.S. Cl.

CPC ..... *H04R 5/04* (2013.01); *G10L 21/0216* (2013.01); *H04R 3/12* (2013.01); *G10L 2021/02163* (2013.01)

(58) Field of Classification Search

None

See application file for complete search history.

(56) References Cited

U.S. PATENT DOCUMENTS

| | | | | |
|---|---|---|---|---|
| 5,677,987 | A * | 10/1997 | Seki | H04R 3/02 704/226 |
| 8,917,885 | B2 * | 12/2014 | Sakurada | H04R 3/02 381/103 |
| 2003/0053647 | A1 * | 3/2003 | Kates | H04R 3/002 381/318 |
| 2007/0164885 | A1 * | 7/2007 | Andersen | H03M 7/3011 341/143 |
| 2014/0086434 | A1 * | 3/2014 | Bang | A61B 5/123 381/98 |
| 2021/0136230 | A1 * | 5/2021 | Li | H04R 3/02 |

* cited by examiner

*Primary Examiner* — Hemant S Patel

(74) *Attorney, Agent, or Firm* — Muncy, Geissler, Olds & Lowe, P.C.

(57) ABSTRACT

A method for automatically detecting audio feedback in an input audio signal includes separately filtering the audio input signal with a plurality of separate analysis audio filters to generate a plurality of filtered audio signals. The separate analysis audio filters are different. Then, comparing at least two of the filtered audio signals to obtain an energy level difference. Performing one or more repetitions of the steps of filtering and comparing to establish a plurality of the energy level differences. Then comparing energy level differences from at least two of the repetitions to detect the audio feedback. The method includes features of automatically performing audio feedback suppression of the detected audio feedback.

19 Claims, 10 Drawing Sheets

| | |
|---|---|
| 3 | Tone detector |
| 4 | Feedback detector |
| 5a | First filtering unit |
| 5b | Second filtering unit |
| 7 | Comparator unit |
| 9 | Sustain detector |
| 11 | Feed-back state validator |

| | |
|---|---|
| 3 | Tone Detector |
| 4 | Feedback Detector |
| 13 | Feedback suppression unit |
| 17 | Preprocessor |
| 51 | Processing unit |

| | |
|---|---|
| 3 | Tone detector |
| 4 | Feedback detector |
| 5a, b, c | Filtering unit |
| 7a, b | Signal comparators |
| 19a, b, c | Energy detectors |
| 20 | Frequency mapping unit |
| 23 | Periodic detection unit |
| 24 | Threshold detector |
| 25a, b | Preprocessing filters |
| 39a, b | Periodic filters |
| 40a, b | Delay units |

| | |
|---|---|
| 5a-e | Filtering units |
| 7 | Signal comparator |
| 19 a-e | Energy Detectors |
| 20 | Frequency Mapping Unit |

| | |
|---|---|
| 4 | Feedback detector |
| 9 | Sustain detector |
| 11 | Feedback state validator |
| 28 | Harmonics detector |
| 29 | Energy level detector |
| 30a-e | Harmonics filter |
| 40 | Delay Unit |
| 42 | Absolute determiner |
| 43 | Envelope Computing unit |
| 44 | Threshold Comparator |
| 46 | Subtraction unit |

| | |
|---|---|
| 19 | Energy detector |
| 48 | Filter bank |
| 49 | Filter parameter computing unit |

AUDIO FEEDBACK DETECTION AND SUPPRESSION

CROSS REFERENCE TO RELATED APPLICATIONS

The present application claims priority to U.S. provisional patent application No. 62/972,894, which was filed on Feb. 11, 2020, the entire contents of which are hereby incorporated by reference.

FIELD OF THE INVENTION

The present invention relates to a method and an apparatus for detecting and, optionally, suppressing audio feedback in an input audio signal. The invention further relates to use of the apparatus.

BACKGROUND OF THE INVENTION

Audio feedback can occur in many situations within the technical field of audio. It may for example occur if a sound loop exists which has both an audio input, such as a microphone, and an audio output, such as a loudspeaker, particularly, if audio is amplified prior to being outputted by the loudspeaker. In such cases, any audio recorded by the microphone may be amplified before being reproduced by the loudspeaker and being recorded again by the microphone, thus constituting a positive loop gain.

Feedback may occur in a wide range of contexts, from large live music concerts to micro-electrical audio circuits, such as circuits for use in hearing aids or headphones and hearables.

Although audio feedback is sometimes used intentionally, it is typically an undesired feature of an audio system. Audio feedback may for example annoy a user of the audio systems, and in worst cases, damage audio equipment or even impair hearing of people near the audio system.

Thus, providing solutions for detecting audio feedback is highly desirable. Particularly, solutions which require relatively little computational power are desirable, such that audio feedback can be quickly identified and dealt with before damage or injury happens.

SUMMARY OF THE INVENTION

The inventor has identified the above-mentioned problems and challenges related to audio feedback and subsequently made the below-described invention which may possibly improve detection and suppression of audio feedback.

The invention relates to a method for automatically detecting audio feedback in an input audio signal; said method comprising the steps of: separately filtering said audio input signal with a plurality of separate analysis audio filters to generate a plurality of filtered audio signals; wherein said separate analysis audio filters are different; comparing at least two filtered audio signals of said plurality of filtered audio signals to obtain an energy level difference; performing one or more repetitions of said step of separately filtering said audio input signal and said step of comparing said filtered audio signals thereby establishing a plurality of said energy level differences; comparing at least two energy level differences of said plurality of energy level differences obtained from at least two of said repetitions to detect said audio feedback.

In an exemplary embodiment of the invention the method is implemented in an audio processing unit. An input audio signal is provided, for example an audio signal from a microphone, which may comprise audio feedback. The method of the present invention may thereby be applied to detect audio feedback in the microphone signal, and various embodiments of the invention may implement tools to make the detection more reliable or accurate, and/or tools to suppress the audio feedback, as described in more detail herein.

A plurality of analysis audio filters, for example two analysis audio filters, are applied to the input audio signal to generate a filtered audio signal for each analysis audio filter. Because the analysis audio filters are different, they will provide different filtered audio signals when given an identical input. In an example, two of the analysis audio filters may for example be bandpass filters centered at 40 Hz and 200 Hz, respectively. When the input audio signal contains audio feedback at approximately 40 Hz, the filtered audio signal output from the first bandpass filter centered at 40 Hz will not be substantially attenuated, but the second bandpass filter centered at 200 Hz will substantially attenuate the input audio signal, for example by 20 dB, when generating the second filtered audio signal. On the contrary, in the same example of filter selections, when the audio feedback exists at approximately 200 Hz, the filter centered at 40 Hz will substantially attenuate the input audio signal, whereas the second analysis audio filter will not substantially attenuate the input audio signal. Generally, if the feedback lies anywhere between the frequencies of the two analysis audio filters, the two filtered audio signals will in combination contain a unique relative attenuation of the input audio signal. This unique relationship between the frequency and relative attenuation can be analyzed to obtain an estimation of the frequency characteristic of the feedback. The two filtered audio signals are compared to obtain an energy level difference, which is indicative of the frequency characteristics of the feedback.

When the input audio signal comprises a prominent tone such as for example audio feedback which stands out from the other content such as for example music, speech or noise, the relative attenuation between the two different analysis audio filters is primarily based on the prominent tone and can be used to uniquely identify for example the frequency of the audio feedback. However, when the input signal does not comprise a prominent tone, i.e., for example no audio feedback, the relative attenuation between the analysis audio filters will vary significantly and not be very useful.

The filtering and comparison steps are therefore preferably repeated to establish a plurality of energy level differences measured over time, and the development of the energy level differences is analyzed. Thus, when approximately similar energy level differences are detected across for example 50 ms, the energy level differences may be validated as representing audio feedback. In an embodiment, a feedback detection validator may thus determine when the difference over a number of repetitions is approximately zero and consider this a validation that audio feedback is detected, and when the difference is not approximately zero, the result is validated as audio feedback is not detected. This feature may also be referred to as sustain detection, i.e., determining whether the input audio signal contains a sustained, prominent tone, which could likely come from audio feedback.

The invention allows detection of feedback in an input audio signal. Other approaches to detect audio feedback exists within the prior art. In comparison, embodiments of the present invention may provide an audio feedback detection, which advantageously may be independent of volume of input audio signal, may be faster, may be cheaper or easier to implement, and/or which may require less computational power. Some of these advantages, or other advantages, may be achieved to different extent and in different combinations by various embodiments of the present invention.

The invention is thus useful in applications where detecting audio feedback in an input audio signal is required or beneficial, for example with the purpose of suppressing the audio feedback. Such applications may for example include any situation where a microphone is applied to obtain and provide audio for playback through a loudspeaker placed such that the microphone further obtains and provides to the loudspeaker the audio played back through the loudspeaker. The microphone and the loudspeaker thereby constitute a feedback loop. Some specific examples of situations where this may occur include musical concerts, theatrical plays, musical rehearsals, during phone calls or calls made with a computer system, or when using hearing aids or headphones with built-in microphones.

THE DRAWINGS

Various embodiments of the invention will in the following be described with reference to the drawings where:

FIGS. 1*a-b* illustrates an embodiment of the invention and an associated visual representation of two analysis audio filters of that embodiment;

Figure 9A:
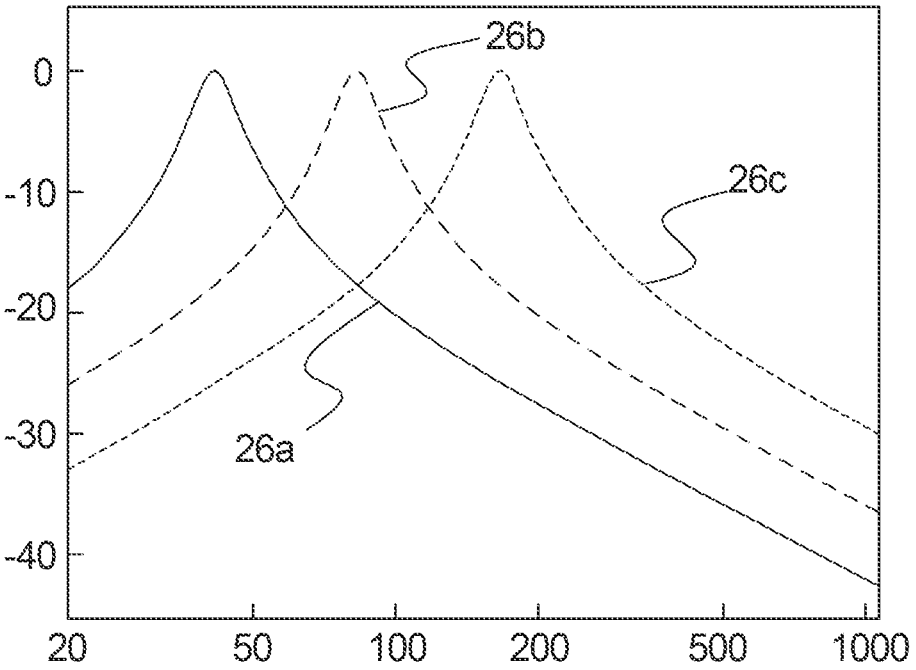
Figure 9B:
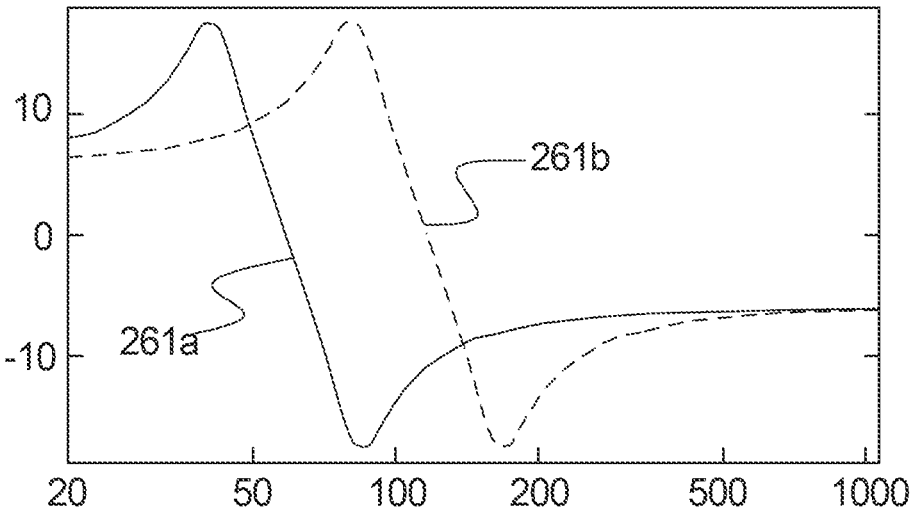
Figure 10A:
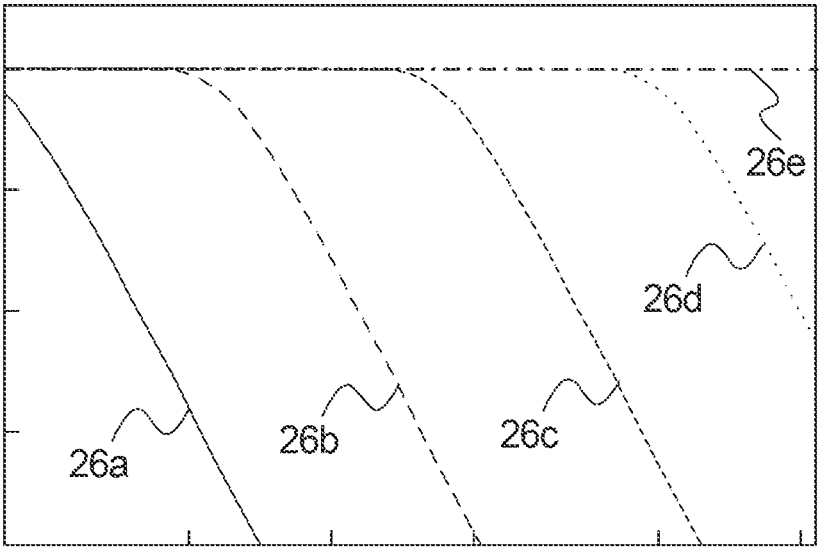
Figure 10B:
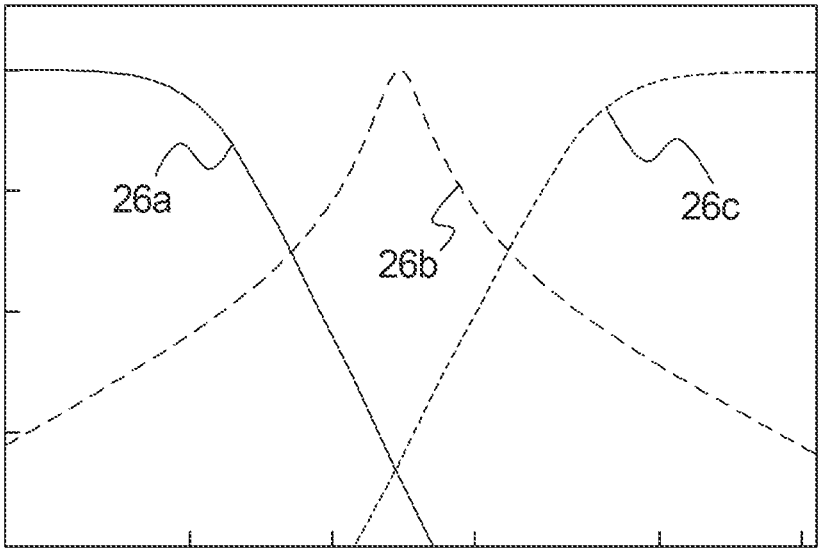
Figure 10C:
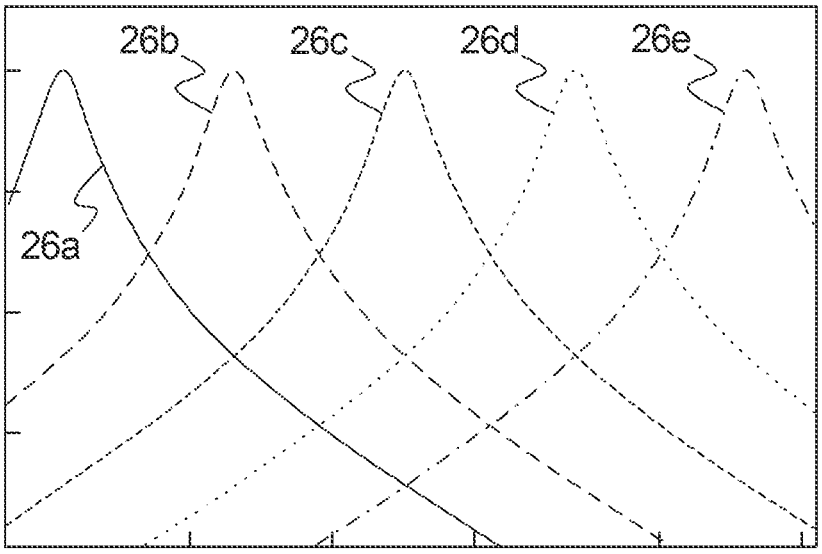
Figure 11:
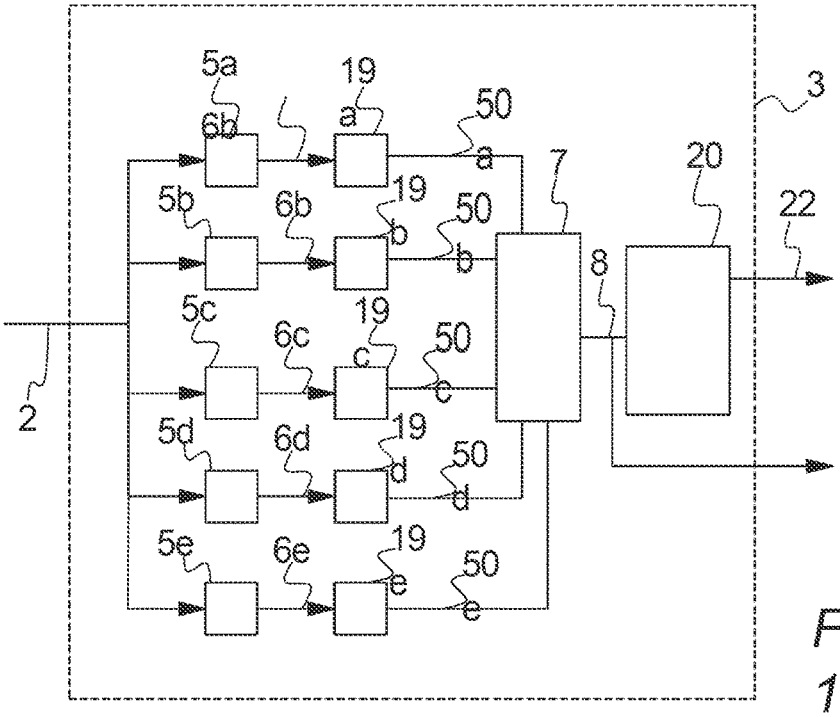
Figure 12:
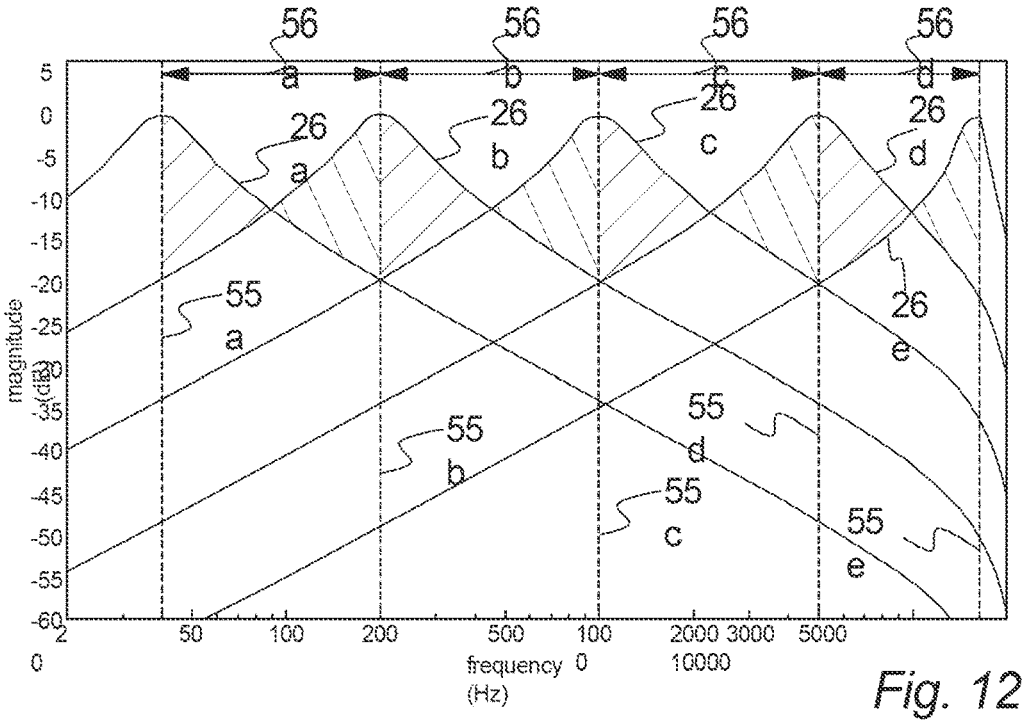
Figure 13:
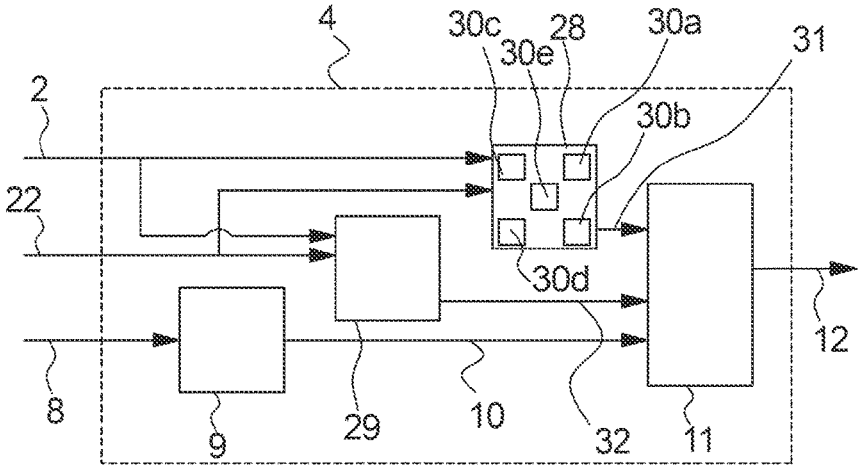
Figure 14:
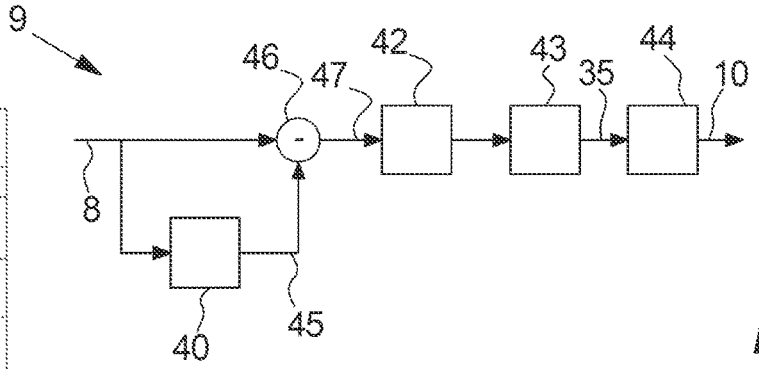
Figure 15:
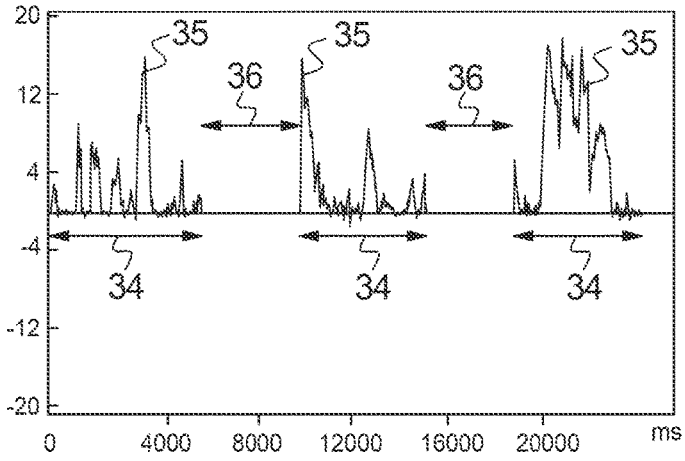
Figure 16:
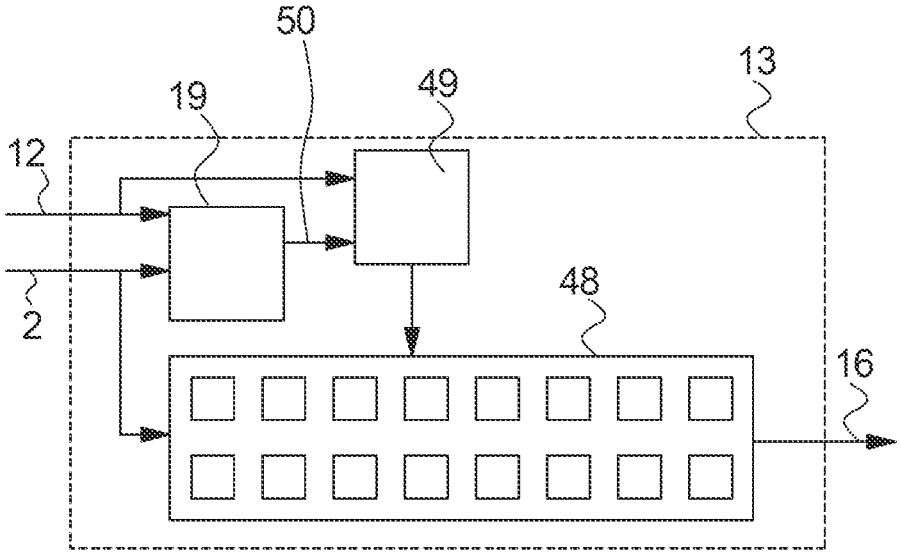
Figure 17:
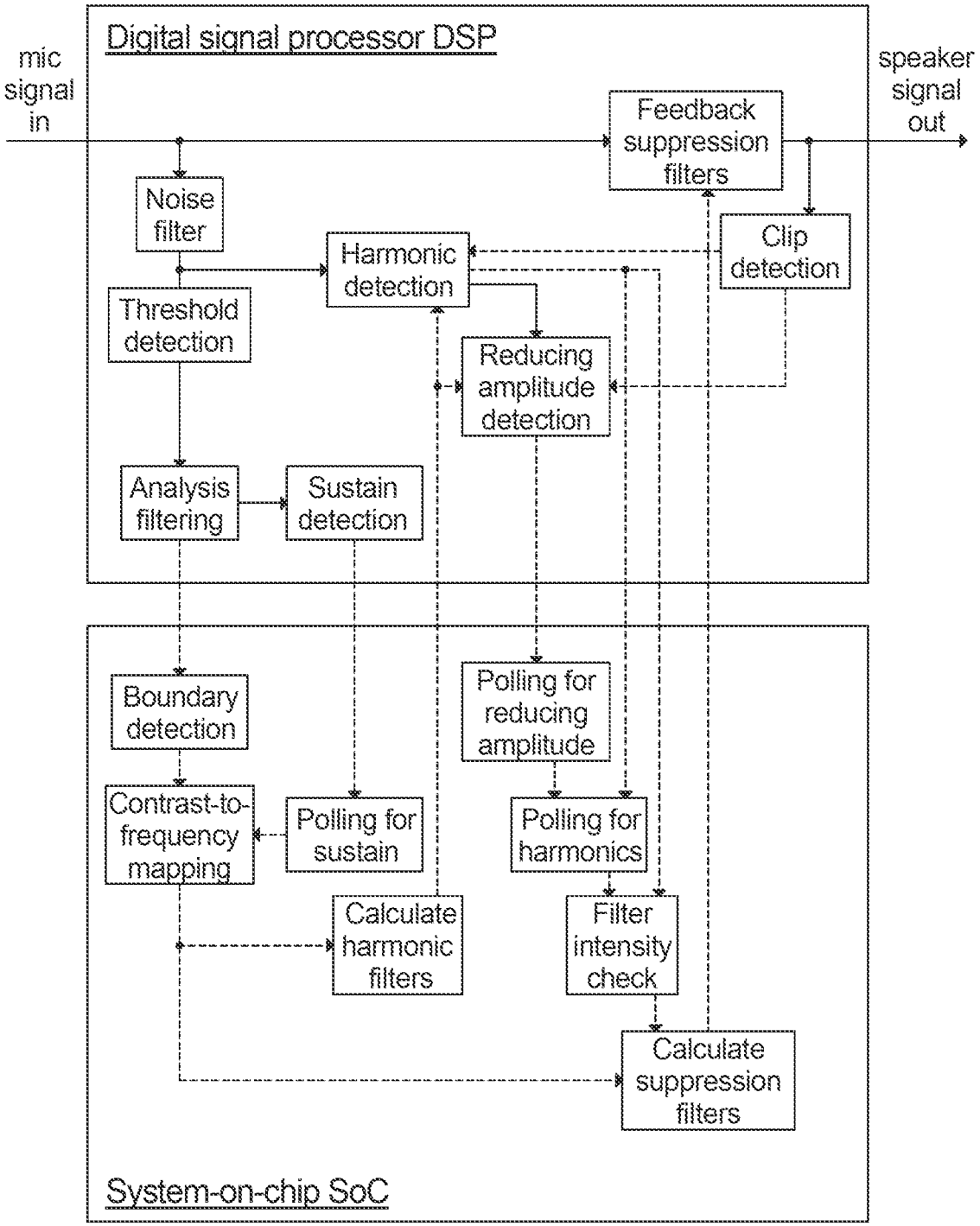

FIGS. 9*a-b* illustrate an embodiment of three analysis audio filters and their corresponding relative attenuation;

FIGS. 10*a-c* illustrate visual representations of various other analysis audio filter combinations;

FIG. 11 illustrates an embodiment of a tone detector according to the invention, FIG. 12 illustrates a visual representation of five analysis audio filters;

FIG. 13 illustrates an embodiment of a feedback detector unit according to the invention;

FIG. 14 illustrates an embodiment of a sustain detector 9 according to the invention;

FIG. 15 illustrates a visual representation of the energy level difference change as a function of time;

FIG. 16 illustrates an embodiment of a feedback suppression unit according to the invention; and FIG. 17 illustrates an embodiment of the invention, where an audio processing system for detecting and suppressing audio feedback according to the invention has been implemented on an audio digital signal processor DSP and a system-on-chip SoC.

DETAILED DESCRIPTION

In the following, various concepts of the invention are presented without reference to particular embodiments.

An input audio signal may for example be understood as a type of digital or analog signal representing audible sound. The audio input signal may for example be suitable for being supplied to a loudspeaker, optionally with one or more intermediate steps of amplification, conversion (e.g., digital-to-analogue), or other processing, for example audio feedback suppression. The input audio signal may for example be supplied through an audio signal input, for example a wired or wireless connection to an audio signal source. The input audio signal may also for example be provided via a pickup or microphone recording a sound upon which the input audio signal is based. Furthermore, it is understood that the input audio signal may also be provided by any kind of electrical component or circuit.

A typical audio signal may be composed of several distinct frequency components. This may for example be evident through a Fourier transformation of the signal. Audio feedback typically results in a prominent tone which may be understood as a frequency component of an audio signal in which that frequency component because of a higher amplitude is at least partly distinguishable from other frequency components of that audio signal. For audio signals comprising several frequency components, for example music, speech, most naturally occurring sounds, noise, etc., a specific frequency component may be considered a prominent tone when the level of that frequency component is clearly discernible from the other signal contents, for example more than 8 dB or 9 dB louder than the other content in the same or neighboring critical band. The prominent tone of undesired audio feedback will, however, typically increase very quickly in level until clipping, thereby becoming a significant disturbance to listeners, and thereby typically being much louder than the above-mentioned 8-9 dB over the level of other audio content.

Some audio signals are composed of a continuum of frequencies, which are dynamically changing in amplitude and phase. In such cases, a prominent tone, and so audio feedback, may not be entirely well-defined. In some embodiments of the invention, special care is taken to analyze such complex audio signals, for example by implementing additional filters, to nevertheless provide an accurate representation of the prominent tones that may represent audio feedback. Generally, embodiments of the invention are not restricted to detecting feedback in a particular type of audio signal, since a useful representation of an audio feedback may be extracted from even complex audio signals by utilizing suitable processing and analysis tools. However, to not obscure the description of the invention with unnecessary detail, the detection of feedback of an input audio signal will primarily be explained using simple audio signals as examples. Note further, that in most embodiments of the invention, a representation of audio feedback may typically be provided independent of the complexity of the audio signal, but for sufficiently complex audio signals, accuracy or precision may be reduced.

Audio feedback may for example occur when a sound output of a loudspeaker depends on sound recorded by a nearby microphone. Here, a signal received by the microphone may be amplified and passed to the loudspeaker, which in turn outputs an amplified sound, which the microphone can then receive again, thus constituting a feedback loop. Such audio feedback may typically be dominated by a single prominent tone, which the method of the invention may be suitable to identify and optionally suppress. Audio feedback may also be referred to as acoustic feedback or the Larsen effect. In the present description, audio feedback may also be referred to simply as feedback.

An analysis audio filter may be understood as an audio filter which, for example, in turn may be a frequency dependent amplifier circuit, for example working in the audible frequency range, for example up to 20 kHz. An analysis audio filter may thus typically provide frequency-dependent amplification, attenuation, passage, and/or phase shift. An analysis audio filter may for example be implemented as a digital circuit, an analog circuit, and/or programmed onto a programmable unit, such as a digital signal processor. Examples of analysis audio filters are low-pass filters, high-pass filters, bandpass filters, and all-pass filters. An analysis audio filter may be implemented in an audio filter unit, which may both be understood as a physical circuit, or a digitally programmed entity.

When an audio filter has been applied to one audio signal, it will typically result in the generation of another audio signal, for example applying an analysis audio filter to an input audio signal may result in the generation of a filtered audio signal, for example applying a plurality of analysis audio filters to an audio signal may result in a plurality of filtered audio signals. Although at least one of the plurality of filtered audio signals may typically not be restricted to being a filtered signal.

An energy level difference may be understood as a difference between the energy levels of two audio signals. An energy level of an audio signal may for example be an RMS average, a peak value, an average of the square of the audio signal, or an average of an envelope of the audio signal. An energy level of an audio signal may also be related to or indicative of a power level of the audio signal. Typically, an energy level may be indicative of the attenuation of an audio signal. For example, if an audio signal has been attenuated by an audio filter, its energy level will be lower than if the audio signal has not been attenuated. An energy level may for example be quantified by dB, for example relative to some reference energy/intensity/audio volume.

The energy level difference obtained by comparison of at least two audio signals may for example be obtained as a ratio or a subtraction between the energy levels of the two signals. The energy level difference does not necessarily require explicitly calculating two energy levels but may for example be obtained through comparison of two audio signals. The energy level difference may for example, be obtained from the ratio of two audio signals. Alternatively, the energy level difference may be obtained by explicitly calculating a (first) energy level of a first audio signal and a (second) energy level of a second audio signal. Detecting an energy level of an audio signal may for example be facilitated by a level detector. Obtaining an energy level difference may for example be facilitated by an energy level comparator, which may for example use at least two audio signals or two energy levels as inputs.

In the following, various embodiments of the invention are described with reference to the figures.

Figure 1A:
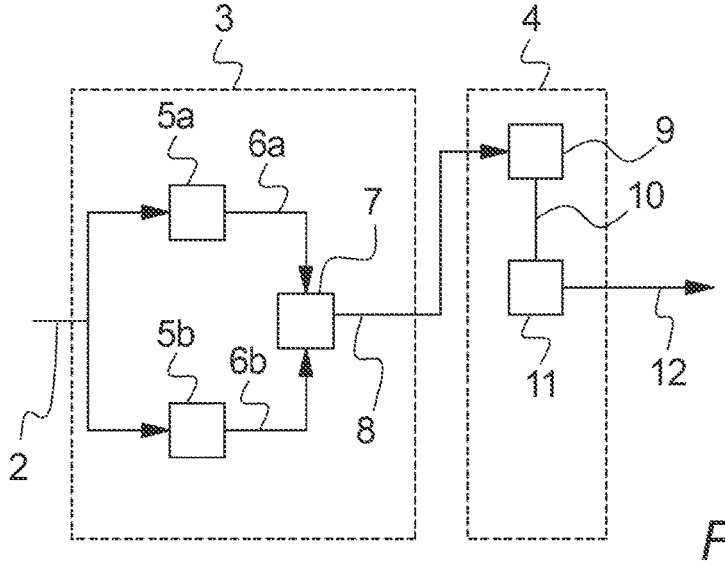
Figure 1B:
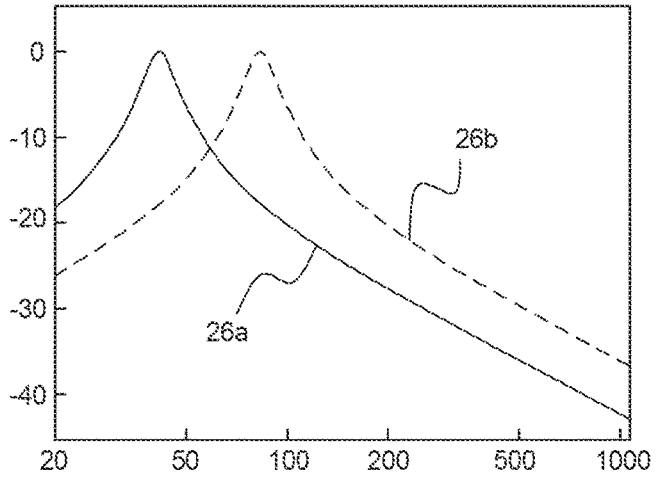

FIGS. 1*a* and 1*b* illustrate schematically an embodiment of the invention.

The embodiment is an automatic audio feedback detection unit, for example an automatic feedback detection unit, which is at least partly implemented using a digital signal processor. The automatic feedback detection unit comprises a tone detector 3 and a feedback detector 4. The tone detector 3 receives an input audio signal 2, for example from an audio signal input. In this exemplary description, the input audio signal 2 comprises a prominent tone.

The input audio signal is separately filtered through a first analysis audio filtering unit 5*a* and a second analysis audio filtering unit 5*b*. The two analysis audio filtering units 5*a*, 5*b* are different in the sense that they apply different analysis audio filters. They may for example both apply bandpass filters with the same quality factor, but with different filter center frequencies.

The effect of the two analysis audio filters is detailed in FIG. 1*b*. The horizontal axis is a frequency axis in units of Hz, while the vertical axis is an energy level axis in units of dB. The frequency-dependent effect that the filtering unit 5*a* and 5*b* applies to an audio signal is illustrated as a first frequency representation of the energy level attenuation 26*a* and a second frequency representation of the energy level attenuation 26*b*. The frequency representations of energy level attenuation 26*a*, 26*b* correspond to bandpass filters with respective center filter frequencies of approximately 41 Hz and 82 Hz. An input audio signal 2, which travels to the energy level comparator unit 7 via the first analysis audio filtering unit 5*a* will thus be attenuated based on the frequency of that audio signal, according to the illustrated first frequency representation of energy level attenuation 26*a*. In contrast, an input audio signal 2, which travels to the energy level comparator unit 7 via the second analysis audio filtering unit 5*b* will be attenuated based on the frequency of that audio signal, according to the illustrated second frequency representation of energy level attenuation 26*b*.

The first and the second filtered audio signals 6*a*, 6*b* are both supplied to the energy level comparator unit 7, which is arranged to compare the two signals 6*a*, 6*b* to obtain an energy level difference 8 of the two signals. Generally, if the energy of the two signals are different, this may be indicated by the energy level difference 8. If a prominent tone is present in the input audio signal, the energy level difference is a representation of this prominent tone. The exact details depend on the type of filter and how exactly the energy level difference is calculated, which may vary between different embodiments. For example, in an exemplified embodiment of the invention, the ratio of the two filtered audio signals 6*a*, 6*b* is generated, and an RMS average of the resulting ratio is measured. However, in this particular embodiment of the invention, the energy level difference 8 is obtained as the subtraction of the energy level of the two filtered audio signals 6*a*, 6*b*.

The obtained energy level difference 8 is supplied to the feedback detector 4. To be able to compare energy level differences over time, a number of energy level differences are stored in a storage unit, for example in the tone detector 3, in the feedback detector 4, or externally. The storage unit may for example be a simple delay holding one or two previous values, or any kind of register, memory, etc. In this exemplary embodiment of the invention, the storage unit is a First-In-First Out (FIFO) buffer. The stored energy level difference 8 may be based on any given length of an input audio signal, for example each sample, or averaged over a number of samples.

As the subsequent audio feedback detection may preferably process the energy level differences at a lower rate than the audio signal processing, e.g., to monitor slower tendencies such as audio feedback built-up, the establishment of energy level differences may be performed at the audio signal processing rate and then utilized at lower rates by subsequent processing, or be performed at lower rates. In an example embodiment of the invention, the energy level difference is only calculated and stored in the storage unit every 50 ms of the input audio signal as this may be a preferable rate of monitoring the development by later feedback detection processing. In other embodiments, the energy level difference is calculated and stored in the storage unit much faster, for example at the rate of audio signal processing.

When two consecutive energy level differences have been obtained, these are compared by a sustain detector 9 of the feedback detector 4 to identify if a prominent tone is sustained across the two energy level difference measurements. This comparison of energy level differences from two different points in time may again be performed at the rate of the energy level difference, which may be the audio signal processing rate, or at a slower rate comparable to the feedback detection rate. For example, the two energy level differences compared are separated by 50 ms, thereby making a sustain detection be based on development over 50 ms of input audio signal. In another embodiment, where the energy level differences are calculated at a faster rate, e.g., at the audio signal processing rate, the energy level difference comparisons, i.e., the sustain detection, may also be performed faster, e.g., at the audio signal processing rate, and the subsequent monitoring of sustain detection output may be performed at a lower rate, such as for example every 20 ms, 30 ms, 50 ms or 80 ms.

A sustained prominent tone may be indicative of audio feedback. Notice that in other embodiments of the invention, the comparison of energy level difference may be based on more than two energy level differences. For example, three consecutive energy level differences may be compared over for example 100 ms to determine that a prominent sustained tone is present in the input audio signal. Generally, if the consecutively obtained energy level differences are different, indicating lack of prominent tone, this may be represented by a sustain state 10 established by the sustain detector 9. If the consecutively obtained energy level differences are approximately similar, indicating presence of a prominent tone, this is also represented by the sustain state. A predetermined energy level difference change threshold may be applied to determine when the change is sufficiently similar to indicate presence of a prominent tone.

The sustain detector 9 may compare energy level differences to obtain a sustain state in multiple different ways. One example is by calculating a ratio of the energy level differences, in other words determining a percentage change from the previous energy level difference. However, in a preferred embodiment of the invention, the sustain detector 9 subtracts the two energy level differences to obtain a subtractive difference between the energy level differences. When this difference is approximately zero, i.e., below an energy difference level change threshold, a sustained prominent tone is detected, and a sustain state 10 comprising this information is supplied to a feedback state validator 11. Also, if the subtraction of the two energy level differences is not approximately equal, a sustain state 10 comprising this information is supplied to the feedback state validator 11.

Based on various different inputs, the feedback state validator 11 determines if the input audio signal comprises audio feedback. In this particular embodiment of the invention, the feedback state validator 11 receives the sustain state 10, and determines that the input audio signal comprises audio feedback, when the sustain state 10 indicates that two energy level differences are approximately equal. The feedback state validator then outputs feedback information 12, such as an audio feedback state. Generally, information as to whether audio feedback is detected or not is given in the feedback information 12, dispatched by the feedback state validator 11. In further embodiments of the invention, the feedback information 12 may contain additional information, including, but not limited to, for example a frequency of the detected audio feedback, the energy level difference of the detected audio feedback, obtained from the prominent tone associated with the audio feedback, and/or the audio feedback energy level.

The embodiment of FIG. 1 is thus able to detect audio feedback in an input audio signal. If, for example, an input audio signal 2 is dominated by a prominent tone at frequency of approximately 75 Hz, and the two analysis audio filters are as shown in FIG. 1*b* described above, centered at 41 Hz and 82 Hz, respectively, the first filtered audio signal 6*a* is attenuated by approximately 15 dB compared to the input audio signal 2, while the second filtered audio signal is attenuated approximately 5 dB compared to the input audio signal. The filtered audio signal comparator 7 compares the filtered audio signals 6*a*, 6*b* and obtains an energy level difference 8 of approximately 10 dB for, for example for a first 50 ms of input audio signal. The energy level difference 8 is then supplied to the feedback detector unit 4, where it is stored in the FIFO buffer. Then, in a repetitive step, a second energy level difference, for example corresponding to the next 50 ms of input audio signal, is obtained and stored in the FIFO buffer. In this example, the two 50 ms intervals of input audio signal is dominated by the same 75 Hz prominent tone. Consequently, the two consecutive energy level differences obtained are approximately equal at 10 dB each. The sustain detector 9 takes the two first values in the FIFO buffer and compares them, and based on this comparison, determines that the two energy levels are approximately equal and that sustain is detected. The sustain detector then dispatches a sustain state 10 comprising this information. The feedback state validator 11 receives the sustain state and based on the affirmative sustain state, determines that the input audio signal having a length of 100 ms comprise audio feedback. The feedback state validator then dispatches a feedback information 12 comprising this information, for example as an audio feedback state. The feedback information may be supplied to a user or to a further audio processing unit for further audio analysis. Preferably the audio feedback information is subsequently used to handle, e.g., reject, the audio feedback. Notice that even if the audio volume of the input audio signal is changed between difference measurements, the obtained energy level difference and hence the representation of the prominent tone is largely unaffected as the detection is based on relative levels between the analysis audio filters.

If the energy level difference 8 of an input audio signal is 10 dB at a first measurement, and a consecutive energy level difference measurement gives 15 dB difference, the sustain detector 9 would determine that the two consecutive energy level differences are too different, and dispatch a sustain state indicating that sustain was not detected. Based on this sustain state, the feedback state validator would dispatch feedback information 12, comprising the information that the audio signal comprises no audio feedback. In other embodiments of the invention, the feedback state validator only dispatches feedback information 12, if the feedback state validator determines that the input audio signal comprise audio feedback.

At sufficiently large frequencies or frequencies at low volume of the input audio signal, the input audio signal 2 may be attenuated by the analysis audio filters 5*a*, 5*b* to such a degree that it is not possible to obtain an energy level difference 8, which is reliably indicative of the frequency due to poor signal-to-noise ratio of the filtered audio signal 6*a*, 6*b*. However, note that filter types and configurations may be varied within the scope of the invention, which may for example result in other frequency limits, or even no frequency limits (e.g., by implementing a large number of unique filters covering all frequencies). Thus, the invention is not limited to any particular frequency ranges.

Figure 2:
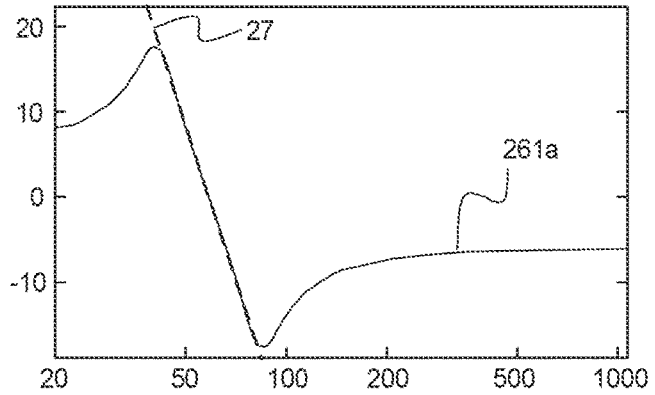
FIG. 2 illustrates an embodiment of a relative attenuation of two analysis audio filters.

FIG. 2 illustrates a frequency representation 261*a* of the relative attenuation that the two analysis audio filters illustrated in FIG. 1*b* may apply to an input audio signal comprising a prominent tone. Below approximately 58 Hz, the relative attenuation is larger than 0, and above, the relative attenuation is below 0 dB. This reflects that the first frequency representation 26*a* lies higher on the attenuation axis than the second one 26*b* below this frequency and vice versa.

The relative attenuation may typically for various embodiments for example be the basis for the energy level difference. In an approximate frequency range determined by the center filter frequencies of the analysis audio filters, the frequency representation 261*a* displays a linear slope. This linear slope may be used to convert an energy level difference into a representation of the prominent tone, using a difference-to-frequency mapping function 27. In this exemplary illustration, the mapping function 27 is simply a straight line (on a non-linear scale, however). Thus, for example, a relative attenuation of approximately 8 dB may be converted by the mapping function 27 into a frequency of 50 Hz.

Note that this exemplary mapping function 27 is not an accurate representation of the frequency representation of the relative energy level attenuation 261*a* outside the filter center frequencies of the two analysis audio filters, such as for example those analysis audio filters illustrated in FIG. 1*b*. The approximate range determined by the two center filter frequencies do thus constitute a valid frequency band.

In other embodiments, one or more mapping functions may be utilized to also obtain an accurate representation of the prominent tone outside the filter center frequencies of the filter units/analysis audio filters.

Figure 3:
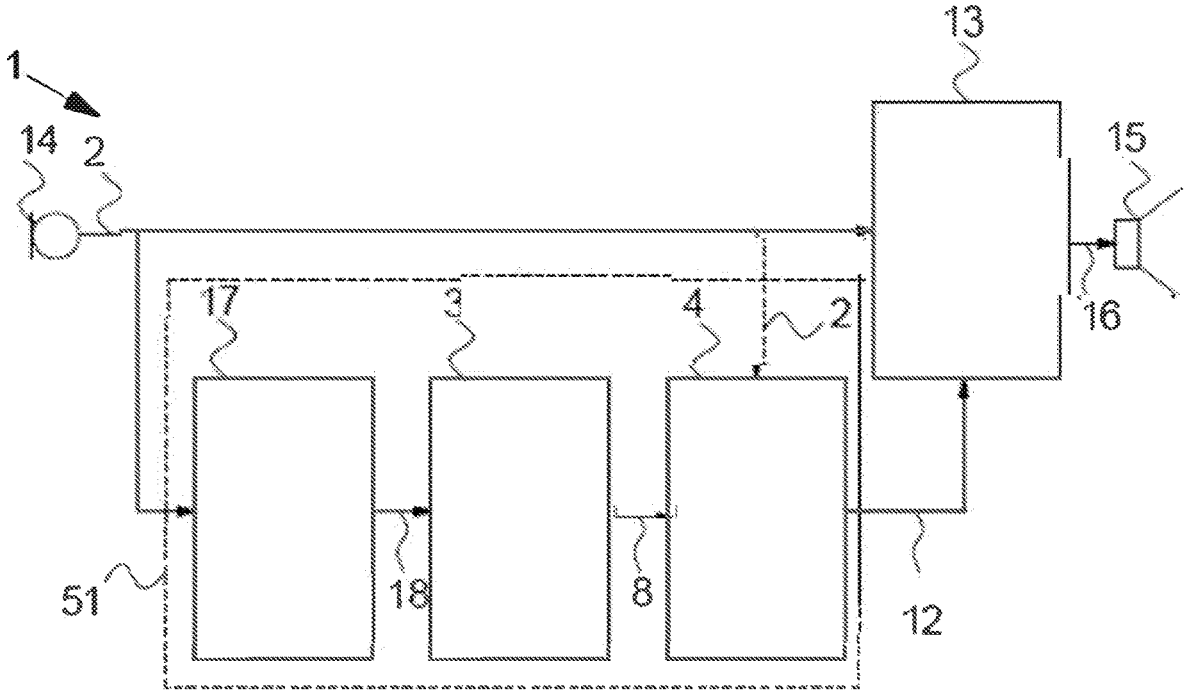
FIG. 3 illustrates a schematic overview of an embodiment of the invention.

FIG. 3 illustrates a schematic overview of an embodiment of the invention, which may for example be implemented in an audio processing system 1 used for receiving and amplifying sound at concerts, rehearsal spaces, in theaters, in hearing aids, in headsets, in cell phones or in personal computers, etc. This particular embodiment of the invention is capable of receiving sound from a microphone as an audio signal, detecting audio feedback in the audio signal, suppressing detected audio feedback, and supplying the audio signal wherein detected audio feedback has been suppressed, to a loudspeaker for sound reproduction.

The illustrated embodiment comprises a microphone 14, which converts received sound into an input audio signal 2, a processing unit 51 configured for detecting audio feedback, a feedback suppression unit 13 configured for suppressing detected audio feedback, and a loudspeaker 15 for producing sound based on an output audio signal 16, wherein detected audio feedback is suppressed. The processing unit 51 comprises a preprocessor 17, the tone detector 3, and the feedback detector 4. The microphone, which may also be an instrument pickup, receives sound from for example an instrument or voice. Additionally, for example in most live settings, the microphone 14 may additionally receive sound produced by the loudspeaker 15, and thereby a feedback loop may be established which under certain circumstances causes loud, undesired, possibly damaging, audio feedback.

Figure 5:
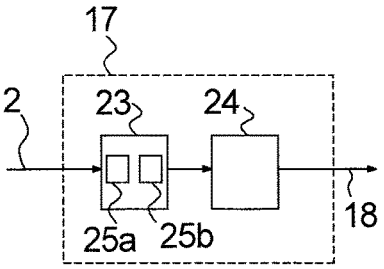
FIG. 5 illustrates an embodiment of a preprocessor according to the invention.

A continuous sound is received by the microphone 14 and converted into an input audio signal 2. The input audio signal can be digital or analog. The input audio signal may also undergo various types of conventional audio processing, such as microphone amplification, buffering, mixing, etc., before being processed by the present invention. The input audio signal is received by the preprocessor 17 and the feedback suppression unit 13. An example embodiment of a preprocessor 17 of the invention is illustrated in FIG. 5. The preprocessor 17 prepares the input audio signal 2 for feedback detection by for example noise filtering, and outputs a preprocessed audio signal 18, which is received by the tone detector 3, such as the one illustrated in FIG. 1*a*, or as described in further detail below. The tone detector 3 outputs an energy level difference 8, which is a representation of a prominent tone, if any, in the input audio signal 2. Then, a feedback detector unit 4, of which an embodiment hereof is illustrated in FIG. 1*a*, or as described in further detail below, receives the energy level difference 8.

In some advanced embodiments of the invention, the feedback detector unit 4 may, in addition to what is described above, perform additional validation of audio feedback presence which may require access to the input audio signal 2 as indicated by the dashed line. For example, it may be configured to evaluate harmonics and subharmonics of a potential audio feedback prominent tone as described below with reference to FIG. 13.

The steps of receiving sound, preprocessing an input audio signal and generating energy level differences is repetitive or may be continuous. Thus, the energy level differences may be interpreted as a signal, which can be both continuous or digital, and as elaborated above, be at the audio signal processing rate or a monitoring rate.

The feedback detector unit 4 compares the received energy level differences to determine their difference. The comparison can be carried out continuously, or for example every sample, or at slower rates, for example at intervals between 10 and 150 ms. Based on this comparison, the feedback detector unit 4 outputs feedback information 12 indicating whether the input audio signal comprise audio feedback. If the energy level differences are not sufficiently equal, the feedback information 12 indicates to the feedback suppression unit that the input audio signal does not comprise audio feedback to be suppressed. The feedback suppression unit 13 then outputs an output audio signal 16 identical to the input audio signal 2 to a loudspeaker 15, preferably through an amplification unit (not shown), and the loudspeaker 15 produces sound based on the received output audio signal. When the feedback detector unit 4 determines that the compared energy level differences are sufficiently equal to indicate audio feedback, the feedback information 12 informs the feedback suppression unit 13 that the input audio signal comprise audio feedback. The feedback suppression unit 13 then applies filters to the received input audio signal to suppress the frequency of the detected audio feedback, before providing the feedback suppressed output audio signal 16 to the loudspeaker 15, possibly through an amplifier.

The audio feedback frequency is determined as the frequency of the prominent tone identified by the tone detector. The energy level difference is a representation of the frequency of the prominent tone. Thus, one or more feedback suppression filters, described in more detail below, suitable for suppressing the detected audio feedback is applied by the feedback suppression unit, based on the energy level difference.

The number of applied suppression filters, the gain reduction and the center frequency of these filters can be based on the energy level of the feedback and the frequency of the detected audio feedback.

The feedback information 12 may comprise different information. For example, it may comprise one or more energy level differences, the frequency of detected audio feedback and/and an audio feedback state that informs if the input audio comprise audio feedback.

Figure 4:
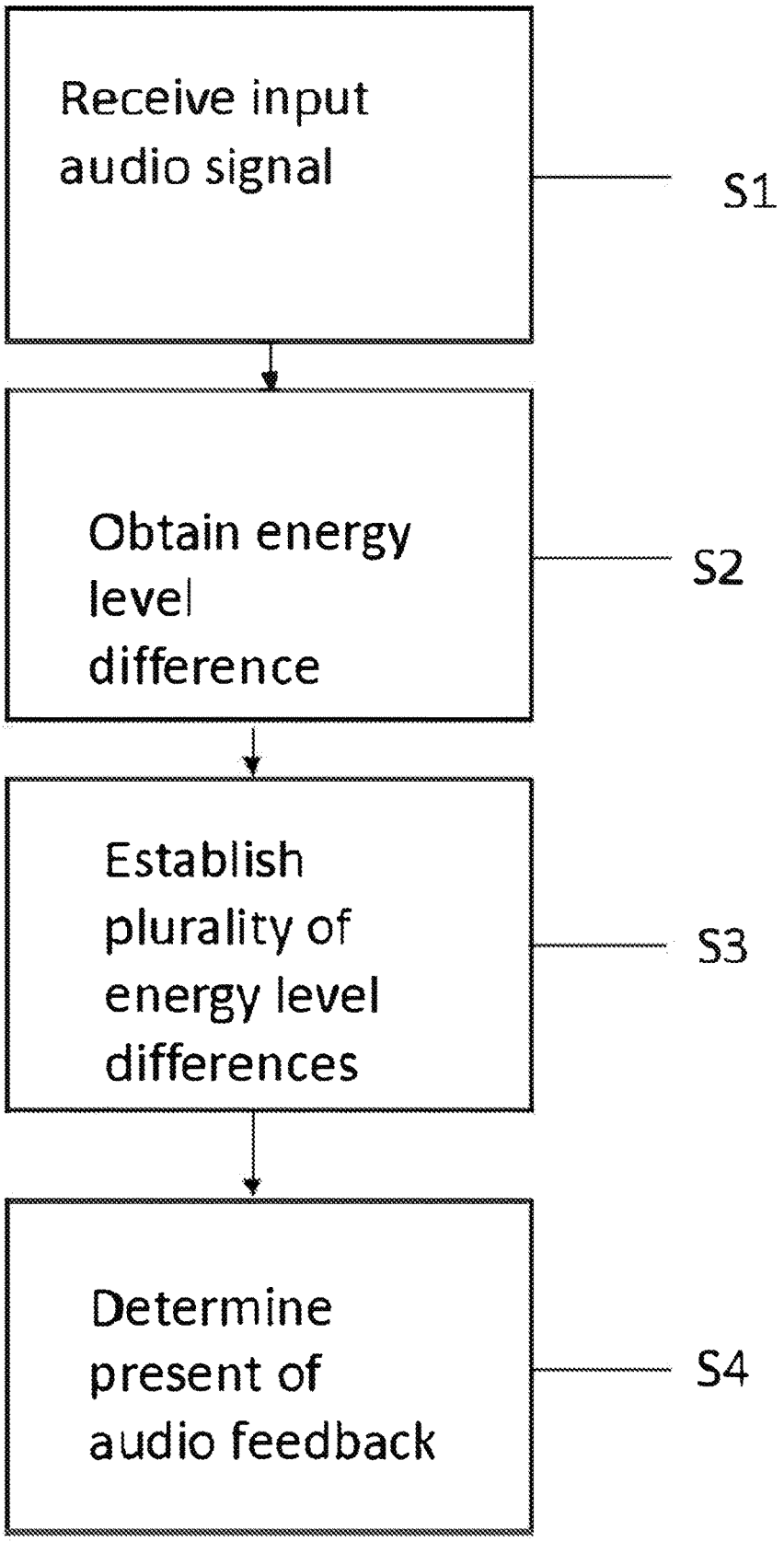
FIG. 4 illustrates an embodiment of a method according to the invention.

FIG. 4 illustrates a visual representation of method steps according to an embodiment of the invention. This embodiment of the invention is able to automatically detect audio feedback in an input audio signal and comprises four method steps S1-S4. However, note that embodiments of the invention are not restricted to these particular method steps. In particular, preferred embodiments may comprise additional steps as described below.

In step S1, an input audio signal is received separately by a plurality of different analysis audio filters, and the analysis audio filters separately filters the received input audio signals, to generate a plurality of filtered audio signals.

In step S2, an energy level difference is obtained by comparing at least two of the generated filtered audio signals.

As step S3, a plurality of energy level differences is established, by performing one or more repetitions of the steps S1 and S2.

In step S4, preferably performed continuously during the repetitions of step S3, presence of audio feedback is detected based on a comparison of at least two energy level differences.

In some embodiments of the invention, the method is implemented on a circuit or a processor which continuously performs the steps of the method repeatedly. Any one or more of the steps may be performed, at least partly, in parallel.

FIG. 5 illustrates an embodiment of a preprocessor, comprising a periodic detection unit 23 having two preprocessing filters 25*a*, 25*b*, and a threshold detector 24. The periodic detection unit 23 reduces the amount of non-periodic noise that is picked up by for example a microphone that supplies the input audio signal 2.

An input audio signal 2 is supplied to the periodic detection unit 23. Herein, the input audio signal is filtered by two preprocessing filters, which may be adaptive filters in a line enhancer configuration. To further improve the signal to noise ratio for the feedback detection, two line enhancer stages are used in series. Other embodiments of the invention may employ other types of filters and other types of configurations of the filters. Non-periodic noise may for example comprise ambient noise and music coming out of a speaker, when the preprocessor 17 is implemented in a sound system comprising a speaker such as illustrated in FIG. 3.

The output of the periodic detection unit 23 is then received by the threshold detection unit 24, wherein the energy level of the signal is measured. When the energy level of the signal exceeds a threshold, for example −40 dBFS, the threshold detection unit 24 outputs a preprocessed audio signal 18 for further analysis.

In other embodiments of the invention the input audio signal 2 may first enter the threshold detection unit 24, whereafter the output of the threshold detection unit 24 is received by the periodic detection unit. This has the advantage that filtering by the periodic detection unit is only applied if the threshold is reached and the likelihood of audio feedback in the input audio signal is higher compared to when the energy level of the input audio signal is lower.

Other embodiments of a preprocessor 17 may comprise additional preprocessing steps for preparing the signal for audio feedback detection.

Figure 6:
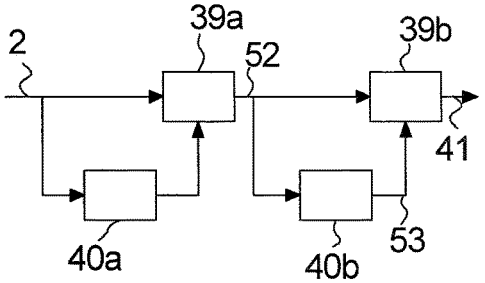
FIG. 6 illustrates an embodiment of the periodic detection unit.

FIG. 6 illustrates a specific implementation embodiment of the periodic detection unit 23, also illustrated in FIG. 5. The particular implementation illustrated in FIG. 6 comprises two periodic filters 39*a*, 39*b* in series, and two delay units 40*a* and 40*b*.

A first periodic filter 39*a* receives an input audio signal 2 and a delayed input audio signal delayed by a first delay unit 40*a*. The first audio filter 39*a* then reduces non-periodic content in the input audio signal for example based on correlating components of the input audio signal and the delayed input audio signal. The first periodic filter 39*a* then outputs a first filtered signal 52, which is then received by a second periodic filter 39*b* and by a second delay unit 40*b*. The second periodic filter 39*b* further receives a delayed first filtered signal 53 from the second delay unit 40*b*, and then further reduces non-periodic content in the received first filtered signal, for example, based on correlating components of first filtered signal 52 and the delayed first filtered signal 53.

Figure 7:
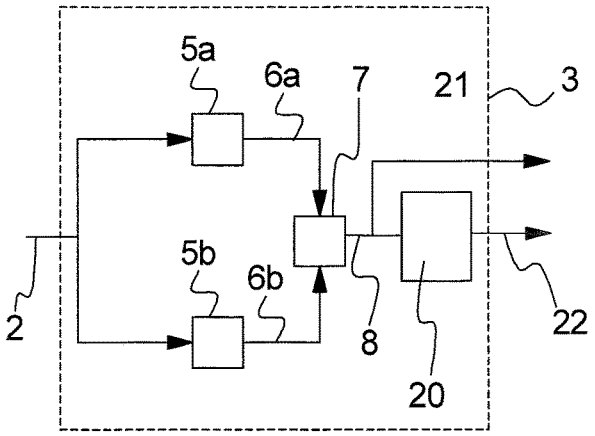
FIG. 7 illustrates an embodiment of a tone detector according to the invention.

FIG. 7 illustrates a particular embodiment of a tone detector 3 according to the invention, having an energy difference-to-frequency mapping unit 20. The embodiment comprises two analysis audio filters 5*a*, 5*b* and a filtered audio signal comparator 7 arranged in a configuration similar to the tone detector 3 illustrated in FIG. 1. The energy level difference 8 established by the filtered audio signal comparator 7 is received by the energy difference to frequency mapping unit 20, which converts the energy level difference 8 into a representation, e.g., frequency, of the prominent tone, using a difference-to-frequency mapping function, and outputs this representation of the prominent tone as a representative tone frequency 22. An illustrative example of a difference-to-frequency mapping function 27 is given in FIG. 2.

The difference-to-frequency mapping function may be implemented in different ways. It may for example be a linear function or a non-linear function. It may also be implemented as a look-up table.

Figure 8:
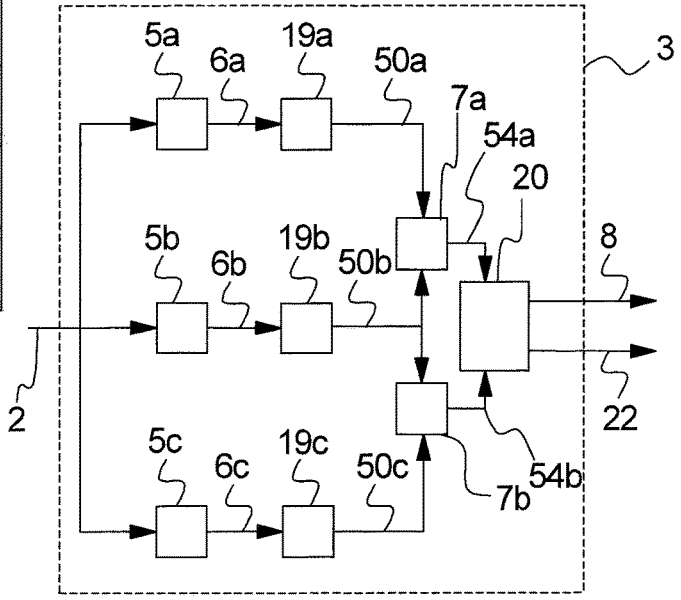
FIG. 8 illustrates a three-filter embodiment of a tone detector according to the invention.

FIG. 8 illustrates an embodiment of a tone detector according to the invention, based on three analysis filters 5*a*, 5*b*, 5*c*, two filtered audio signal comparators 7*a*, 7*b* and three energy detectors 19*a*, 19*b*, 19*c*. This embodiment is substantially similar to the embodiment of FIG. 7. However, the embodiment of FIG. 8 further comprises a third analysis audio filter 5*c* that filters the input audio signal to obtain a third filtered audio signal 6*c*. An example of three suitable analysis audio filters is described below with reference to FIGS. 9*a*-9*b*. Moreover, this embodiment comprises energy detectors 19*a*, 19*b*, 19*c*, which detects the energy level 50*a*, 50*b*, 50*c* of the filtered audio signals 6*a*, 6*b*, 6*c*, supplied by the analysis audio filters 5*a*, 5*b*, 5*c*. Once the first filtered audio signal 6*a*, the filtered audio signal 6*b*, and the third analysis audio signal 6*c* has been established, these signals are processed by two energy level comparators 7*a*, 7*b* to obtain two tentative energy level differences 54*a*, 54*b*, which in turn is supplied to an energy difference to frequency mapping unit, to determine a representative tone frequency 22 based on difference-to-frequency mapping function, and an energy level difference 8.

The filtered audio signals outputted by two neighboring analysis audio filters with highest output energy levels determines roughly in which region, i.e., between which two analysis audio filters, the frequency of the prominent tone, if any, is. Thereby, in this particular embodiment of the invention, the energy level difference 8 is selected as the one of the two tentative energy level difference 54*a* or 54*b*, that is obtained based on the neighboring pair of filtered audio signals with the highest energy level.

In this embodiment of the invention, the representative tone frequency 22 is based on the energy level difference 8.

FIG. 9*a-b* illustrate a visual representation of three analysis audio filters and their corresponding relative attenuation. FIG. 9*a* is similar to FIG. 1*b*, except that the visual representation of FIG. 9*a* corresponds to three analysis audio filters, for example as implemented as first, second, and third analysis audio filters in the embodiment illustrated in FIG. 8. In FIG. 9*a*, the three frequency representations of energy level attenuation 26*a*, 26*b*, 26*c* correspond to bandpass filters with respective center filter frequencies of approximately 41 Hz, 82 Hz, and 165 Hz.

In FIG. 9*b*, a first relative attenuation 261*a* corresponding to the difference in attenuation that the first and second frequency representations of energy level attenuation 26*a*, 26*b* applies is illustrated. Furthermore, a second relative attenuation 261*b* corresponding to the difference in attenuation that the second and third frequency representations of energy level attenuation 26*a*, 26*b* apply is illustrated. The first 261*a* and second representation 261*b* in FIG. 9*b* each have a steep slope in a separate frequency regime. Thus, a first pair of filters, corresponding to the first 26*a* and second representation 26*b* in FIG. 9*a*, may provide an accurate measure of the frequency of the prominent tone in a first frequency regime, whereas a second pair of filters, corresponding to the second 26*b* and third representation 26*c* in FIG. 9*a*, may provide an accurate measure of the frequency of the prominent tone in a second frequency regime. These different optimal frequency ranges may be combined, e.g., by the frequency-mapping unit or through a weighted average.

FIGS. 10*a-c* illustrate visual representations of various other analysis audio filter combinations. Each of the subfigures illustrate the representations on a horizontal axis which is an arbitrary frequency axis and a vertical axis which is an arbitrary energy level axis.

FIG. 10*a* illustrates using a plurality of low-pass filters in embodiments of the invention. Each individual filter may, in combination with another filter of higher cutoff frequency, be used to determine a representation of a prominent tone in a frequency range. By having a plurality of low-pass filters, instead of for example a single one, it is possible to combine the individual frequency ranges to cover any arbitrary range of frequencies. For example, a first filter illustrated as the leftmost representation 26*a* may, in combination with any of the other filters illustrated as representations 26*b*-26*e* with higher cutoff frequency, cover a first frequency range. Then, a second filter illustrated as the next representation 26*b* may, in combination with any of the other filters illustrated as representations 26*c*-26*e* with higher cutoff frequency, cover a next frequency range, etc.

For example, in an embodiment of the invention, at least five separate low-pass filters are implemented with cut-off frequencies 20 Hz, 100 Hz, 500 Hz, 2500 Hz, and 12500 Hz. Such filters may for example have frequency dependencies as visualized in FIG. 10*a* by representations 26*a*, 26*b*, 26*c*, 26*d*, and 26*e*. The first filter represented by the first representation 26*a* may in combination with the third filter represented by the third representation 26*c* be used to cover a frequency range from 20 Hz to 100 Hz. The second filter represented by the second representation 26*b* may in combination with the fourth filter represented by the third representation 26*d* be used to cover the frequency range from 100 Hz to 500 Hz, etc. Such embodiments may optionally also be based on an unfiltered input audio signal for use in a comparison of analysis audio signals.

In other embodiments, a similar principle may be implemented utilizing high-pass filters instead of low-pass filters.

FIG. 10*b* illustrates that a low-pass filter 26*a*, a bandpass filter 26*b*, and high-pass filter 26*c* may be combined in embodiments of the invention. Any other combinations with different numbers of the different filter types are applicable.

FIG. 10*c* illustrates how a plurality of bandpass filters can also be combined to cover any arbitrary range of frequencies. An embodiment of this is elaborated in more detail below with reference to FIGS. 11-12.

FIG. 11 illustrates an embodiment of a tone detector according to the invention, based on five analysis audio filters 5*a*, 5*b*, 5*c*, 5*d*, 5*e*, filtering the input audio signal 2 to establish a filtered audio signals 6*a*, 6*b*, 6*c*, 6*d* and 6*e*. Once the filtered audio signals have been established they are processed by a filtered audio signal comparator 7. The filtered audio signal comparator determines the energy level of each of the five filtered audio signals, and selects the filtered audio signals outputted by two neighboring analysis audio filters with highest output energy levels to determine roughly in which region, i.e., between which two analysis audio filters, the frequency of the prominent tone, if any, is. For example, with reference to FIG. 12 described below, an audio feedback at 3000 Hz will cause filter 26*d* to output the highest filtered audio signal energy level, and filter 26*c* the next highest. Thereby, it can be determined that the audio feedback is between these two filters, and the energy level difference can be determined from the filter audio signals from these two filters. The difference between the energy level of the two filtered audio signals selected from the rough estimation are used as energy level difference for the further method analysis. The energy level difference is supplied to a frequency mapping unit 20 to determine the representative tone frequency 22. Applying five filters broadens the frequency band within which an audio feedback frequency can accurately be detected.

FIG. 12 illustrates a visual representation of five analysis audio filters. Each of these five analysis audio filters may correspond to the embodiment of the invention illustrated in FIG. 11, which comprises five analysis audio filters. In FIG. 12, the horizontal axis is a frequency axis, while the vertical axis is a magnitude axis representing energy level.

FIG. 12 illustrates the use of five band-pass filters with filter peak frequencies of 40 Hz, 200 Hz, 1000 Hz, 5000 Hz and 15500 Hz, in an embodiment of the invention. Each individual filter may, in combination with another filter with a different filter peak frequency, be used to determine a representation of a prominent tone in a frequency range. Notice that the representation of a prominent tone may be an energy level difference. By having a plurality of filters, instead of for example a single filter, it is possible to combine the individual frequency ranges to cover any arbitrary range of frequencies with a precision depending on the number of filters. For example, a first filter illustrated as the leftmost representation 26*a* may, in combination with any of the other filters illustrated as representations 26*b*-26*e* with a higher filter peak frequency, cover a first frequency range. Then, a second filter illustrated as the next representation 26*b* may, in combination with any of the other filters illustrated as representations 26*c*-26*e* with a higher filter peak frequency, cover a next frequency range, etc.

In a specific implementation of the invention illustrated in FIG. 12, pairs of neighbouring analysis audio filters cover a specific frequency range. In this implementation of the invention, a first filter illustrated as the leftmost representation 26*a* may, in combination with a neighbouring filter illustrated as a representation 26*b* with a higher peak frequency 55*b*, cover a first frequency range 56*a*. Then, a second filter illustrated as representation 26*b* may, in combination with a neighbouring filter illustrated as a representation 26*c* with a higher peak frequency 55*c*, cover a second frequency range 56*b*. Further, a third filter illustrated as representation 26*c* may, in combination with a neighbouring filter illustrated as a representation 26*d* with a higher peak frequency 55*d*, cover a third frequency range 56*c*, etc.

In other embodiments, a similar principle may be implemented utilizing other types and ranges of filters.

FIG. 13 illustrates an embodiment of a feedback detector unit according to the invention, which in addition to the sustain detector and feedback state validator also illustrated in FIG. 1 further comprises a reducing energy level detector 29, and a harmonics detector 28 connected to a feedback state validator 11, wherein the harmonics detector 28 comprise five harmonic filters 30*a*, 30*b*, 30*c*, 30*d*, 30*e*.

A representative tone frequency 22 of a prominent tone with a frequency of 500 Hz identified by for example a tone detector as described above, is supplied to the reducing energy level detector 29 and to the harmonics detector 28 along with an input audio signal.

The reducing energy level utilize the incoming representative tone frequency 22 of 500 Hz to repeatedly read the energy level of the 500 Hz frequency in the input audio signal 2. When the energy level of the representative tone frequency is constant or increasing from one repetition to the next it is indicative of the representative tone frequency being audio feedback building up. The reducing energy level detector dispatches this indication to the feedback state validator 11, in form of a reducing energy level state 32. When the energy level of the incoming 500 Hz frequency is reducing, thereby indicative of either the prominent tone not being undesired audio feedback or that it is about to disappear by itself, the energy level detector dispatches this information in the reducing energy level state 32.

The harmonics detector utilizes the representative tone frequency 22, which in this example is a 500 Hz tone, to determine filter coefficients of five harmonic filters 30*a*, 30*b*, 30*c*, 30*d*, 30*e*. In this embodiment of the invention, the filter coefficients are determined such that the harmonic filters are bandpass filters with a peak frequency corresponding to the first, second, third and fourth harmonic and first subharmonic of the representative tone frequency 22. In this example 1000 Hz, 1500 Hz, 2000 Hz, 2500 Hz and 250 Hz. Then, each harmonic filter is applied to the incoming input audio signal 2, and the energy level of the output of each filter is measured. The energy level of the output of each harmonic filter is then compared to a measured energy level of the representative tone frequency 22 of input audio signal. If the energy level of the output of any one of the harmonic filters is above a threshold, e.g., −30 dB relative to the energy level of the representative tone frequency, in the input audio signal, this is indicative that the representative tone frequency is not audio feedback because harmonics exists. In this example the output of all the harmonic filters is below −30 dB relative to the energy level of the incoming 500 Hz representative tone frequency. The harmonics detector thus provides the indication of a lack of harmonic content to the feedback state validator 11, in form of a harmonics state 31.

Similar to the embodiment illustrated in FIG. 1, based on incoming energy level differences, the sustain detector 9 dispatches a sustain state to the feedback state validator 11 comprising information as to whether the representative tone frequency, in this example a 500 Hz tone, is sustained in the input audio signal. In this example the 500 Hz tone is sustained, and thus, the difference between incoming energy level differences remains approximately zero. The sustain detector thus dispatches a sustain state indicating that a prominent tone of the input audio signal is sustained.

The feedback state validator output a feedback information 12 based on the received reducing energy level state 32, the harmonic state 31, and the sustain state 10, which indicate whether the input audio signal comprises audio feedback or not. In this particular embodiment of the invention, the feedback state validator only determines that the input audio signal comprise audio feedback, if there is an indication of a sustained prominent tone, an increasing or constant energy level of the representative tone frequency, and a lack of harmonics of the representative tone frequency in the input audio signal. In this example, all these criteria for audio feedback is met by the 500 Hz representative tone frequency, and thus a feedback information comprising information that audio feedback is detected at 500 Hz is dispatched by the feedback validator 11.

The feedback information 12 may include information regarding the representative tone frequency, energy level of the representative tone frequency as well as further information obtained by the feedback detector unit 4, and potentially additional relevant information.

The feedback information 12 may for example be shown on a screen to enable a user to apply this knowledge, for example to take steps to reduce the detected audio feedback. The feedback information 12 may also be supplied to other audio processing units, for example a feedback suppression unit.

Any of the steps and processing steps performed by the feedback detector unit 4 may advantageously be performed in parallel, to increase the processing speed of the feedback detector unit 4.

It is within the scope of the invention that the steps of evaluating harmonics and subharmonics of the representative tone frequency and the step of evaluating reducing energy levels of the representative tone frequency is performed continuously or alternatively, for example each 50 ms or more often or less often. Notice that in different implementations according to the invention, it may be advantageous to evaluate various different harmonics and subharmonics of the representative tone frequency.

FIG. 14 illustrates an embodiment of a sustain detector 9, according to the invention, comprising a subtraction unit 46, a delay unit 40, an absolute determiner 42, an envelope computing unit 43, and an energy level difference change threshold comparator 44. The sustain detector 9 indicates if a prominent tone of an input audio signal, is sustained over time. Sustain of a prominent tone is indicative of this tone being audio feedback.

Energy level difference 8, which is representative of a prominent tone in an input audio signal, is repeatedly received by the subtraction unit 46 and by the delay unit 40. The delay unit applies a delay to the received energy level difference 8 to repeatedly generate delayed energy level differences. The subtractor repeatedly receives the delayed energy level difference 45 and repeatedly subtract energy level difference 8 from the received delayed energy level difference to repeatedly generate an energy level difference difference 47. An absolute determinator 42 determines the absolute value of the energy level difference 47, whereafter an envelope computing unit calculates the envelope of the absolute of the energy level difference 47 to generate an energy level difference change 35. The energy level difference change comparator 44 then compares the energy level difference change 35 with an energy level difference change threshold, and based on this comparison, outputs a sustain state 10. When the energy level difference is equal to or above the energy level difference change threshold, the sustain state 10 indicates that a prominent tone of the input audio signal is sustained. Otherwise, the sustain state indicate that a prominent of the input audio signal is not sustained.

In this particular embodiment of the invention, the energy level difference change threshold is small, e.g., selected in the range 0.1 dB to 0.5 dB. Thereby, when the energy level difference change is substantially zero, the sustain state indicate that a prominent tone of the input audio signal is sustained. In other embodiments of the invention, it may be relevant to elevate the energy level difference change threshold to a higher value to render the sustain detection more sensitive. In other embodiments it may be preferred to decrease the energy level difference change threshold to a low value closer to zero, to diminish the sensitivity of the sustain detector and thereby diminish the risk of falsely identifying sustain, in term falsely indicating that the energy level difference change pertaining to a prominent tone may represent audio feedback in an input audio signal.

FIG. 15 illustrates according to an embodiment a visual representation of the energy level difference change (in dB subtractive difference) as a function of time (in ms), determined for an input audio signal, which for example comprises musical content and periods of audio feedback. The energy level difference illustrated in FIG. 15 may for example be calculated by the embodiment of the invention illustrated in FIG. 14.

During an interval 34 when the input audio signal only comprises music and no audio feedback, the energy level difference change 35 is varying considerably, as there is no single prominent tone dominating the input audio signal. Conversely, when a prominent tone representing audio feedback emerges in the input audio signal together with the music, as in the interval 36, the energy level difference change suddenly becomes approximately zero and stays approximately constant until the audio feedback is rejected or otherwise disappears.

FIG. 16 illustrates an embodiment of a feedback suppression unit according to the invention, of which a general implementation is also illustrated in FIG. 3. The feedback unit 13 illustrated in FIG. 16 comprises an energy detector 19, a filter parameter computing unit 49 configured for calculating filter coefficients for 16 band rejection filters of a filter bank 48.

The energy detector receives an input audio signal and feedback information 12 from for example a feedback detector unit such as the one illustrated in FIG. 13. In this particular embodiment of the invention, the received feedback information 12 comprise a representative tone frequency, which corresponds to the frequency of audio feedback detected by for example a feedback detector as illustrated in FIG. 13, and information as to whether feedback is detected in the audio signal or not. When the energy detector is informed by the feedback information 12 that feedback is detected in the audio input signal 2, the energy detector reads the energy level 50 of the input audio signal at the incoming representative tone frequency, to detect the energy level of the audio feedback. The energy level 50 of the audio feedback is then supplied to the filter parameter computing unit 49, which in a first step performs a filter intensity check. This step ensures that suppression of the audio feedback is only performed when the energy level of the audio feedback reaches a significant level. This is further a protective mechanism against suppressing for example voice or instruments instead of audio feedback. The significant level may vary according to different implementations of the embodiments. In some embodiments of the invention, the filter intensity check is performed as part of determining if the input audio signal comprise audio feedback.

When a significant level of the audio feedback is detected, the filter parameter computing unit 49 determines filter parameters based on the received representative tone frequency. In this example, it determines the filter coefficients of a band rejection filters of the filter bank 48 so that the center frequency of the band rejection filter is equal to the incoming representative tone frequency. In other embodiments of the invention, the filter parameter computing unit 49 further determines a gain reduction of the band rejection filter at the determined filter center frequency, based on the incoming energy level measured at the representative tone frequency of the input audio signal. In this embodiment of the invention, the gain of the band rejection filter is predetermined at −6 dB, and the quality factor of the band rejection is predetermined at Q=16. Other embodiments of the invention may apply a different filter gain reduction and quality factor.

The filter parameter computing unit 49 submits the calculated filter coefficients to the filter bank, which then configures one of the 16 filters of the filter bank with the received filter coefficients. Then, the received input audio signal 2 is passed through the band rejection filter with filter coefficients corresponding to the representative tone frequency, to generate a filtered audio signal that is dispatched as an output audio signal 16.

The feedback suppression unit is thus able to determine filter coefficients based on a prominent frequency corresponding to a representation of audio feedback in an input audio signal, and then suppress the audio feedback of the input audio signal, to establish an output audio signal with a suppressed audio feedback.

In some embodiments of the invention, the filter computing unit 49 may configure two filters of the filter band 48 with identical filter coefficients. Applying these in series may advantageously double the gain reduction at the specific filter center frequency of the two filters. This may be advantageous if the energy level of the detected audio feedback is high.

In a further advanced embodiment of the invention, the filter parameter computing unit may configure the gain reduction of a filter to correspond to the measured energy level of the audio feedback with the representative tone frequency, or the gain reduction may be configured to correspond to a percentage of the identified energy level of the prominent tone.

The feedback detection unit is configured to only filter the input audio signal if the received feedback information 12 provides information that audio feedback is detected in the input audio signal. When audio feedback is not detected, the input audio signal 2 may bypass the feedback suppression unit.

In an embodiment of the feedback suppression unit 13, the feedback suppression unit 13 stores the representative tone frequency associated with each configured filter and further stores associated energy level of that frequency in the input audio signal. The stored frequency corresponds to a representation of the detected audio feedback frequency. Thereby the feedback suppression unit holds a history of the detected levels and frequency of each current and previously detected audio feedback. When a new audio feedback is detected, and if all the available suppression filters of the filter bank 48 have already been used, then the filter associated with the frequency having the lowest energy level is updated according to the new audio feedback and its associated feedback information 12.

The filter bank 48 may comprise a large number of filters, which may be coupled in series or in parallel. The filters may further be coupled to a multiplexer unit to couple filters in and out, preferably a slewing multiplexer to avoid pops and clicks.

FIG. 17 illustrates an embodiment of the invention, where an audio processing system for detecting and suppressing audio feedback according to the invention has been implemented on an audio digital signal processor DSP and a system-on-chip SoC, respectively. This may be advantageous, as an audio DSP is well suited for processing audio signals including suitable audio processing clock frequencies, efficient audio filtering features possibly including a parametric equalizer, suitable A/D and D/A converters if relevant, etc. On the other hand, some of the calculation, more logic-based processing and event-driven processing may be better suited for implementation on a general purpose processor and access to memory, etc, such as for example provided by a SoC, or a microprocessor combined with external memory, or the like.

In FIG. 17 is illustrated an embodiment of how the various feedback detection and suppression blocks described above may be distributed in the two processors.

The DSP may preferably handle the receipt of a microphone signal, also referred to as input audio signal 2 above, as well as the filtering of the audio signal by feedback suppression filters for example as described with reference to a feedback suppression unit 13 above, and the establishment of the speaker output, also referred to as output audio signal 16 above. Further, the audio DSP may preferably be assigned the tasks of performing preprocessing as for example described with reference to FIGS. 5-6 above, for example including a noise filter and threshold detection. Also the analysis filtering is preferably performed by the filter-optimized audio DSP, and possible subsequent sustain detection, e.g. by analysis audio filters 5*a*-5*e* described above and calculation and possible enveloping of energy level difference changes as for example described above with reference to FIGS. 14-15. Harmonic detection and reducing amplitude detection, which also includes several audio filters, is also preferably handled by the audio DSP, and may for example be implemented as described with reference to FIG. 13 above. A clip detection implemented as an emergency handler when the output audio signal level gets very high with risk of clipping in the speaker, may be implemented in the audio DSP, and may be implemented as described below.

On the other hand, tasks like the typically more involved calculation of filter coefficients, looking up in memory-based look-up tables, monitoring when a certain value exceeds a threshold or flips from true to false, etc., is assigned to the SoC. This may for example include the calculation of a probable audio feedback frequency by a difference-to-frequency mapping as for example described with reference to FIGS. 2 and 7. It may also preferably include the calculation of filter coefficients for the harmonic filters and the feedback suppression filters, as for example described with reference to FIGS. 13 and 16 above. Further tasks preferably done by the SoC may be the monitoring or polling of the sustain detection, or reducing amplitude detection and harmonics detection, of which possible embodiments are described with reference to FIGS. 13-15 above. Also, a filter intensity check may preferably be included in the SoC, e.g. as described with reference to FIG. 16 above.

In the following, various embodiments of the invention are presented without reference to particular figures.

In an embodiment of the invention, said method comprises a step of providing said input audio signal. Providing the input audio signal is not restricted to any particular means. It may for example be provided via a data storage, a wired connection, a wireless connection, an input microphone, an instrument pickup, etc. In an embodiment of the invention, said method comprises a step of recording said input audio signal via an input microphone. According to an embodiment of the invention, an input audio signal may be provided by microphone or by for example an instrument pickup. In a further exemplary embodiment, the audio input signal may be provided as an audio signal, recorded via a microphone or audio pickup. Furthermore, it is understood that in further embodiments of the invention, the input audio signal may be provided by any kind of electrical component or circuit. Audio feedback is typically arising from a microphone or instrument pickup, but may be processed through a number of stages, for example microphone amplifiers, buffers, instrument or vocal effects, mixers, etc. before it is received for the method of the present invention. Even after such processing, the input audio signal may still be considered as provided by a microphone.

In an embodiment of the invention, said method comprises a step of processing said input audio signal to establish an output audio signal. Such processing may for example comprise filtering, amplification, mixing, etc. In a preferred embodiment, the processing may also include audio feedback suppression based on the audio feedback detection of the present invention. This may be highly advantageous when the output audio signal is reproduced acoustically nearby a source of the input audio signal, and thereby is prone to cause the audio feedback. In an embodiment of the invention, said method comprises a step of reproducing, using one or more loudspeakers, an output audio signal based on said input audio signal. The present invention may be highly advantageous when performed in the loop of receiving microphone signals for reproduction by speakers located acoustically nearby the microphones. As such a setup, which is typical for live public address situations such as musical concerts or speeches, is prone to establishing audio feedback, it may be advantageous to be able to detect when it happens to be able to launch countermeasures, e.g., changing the microphone or speaker configuration, reduce volume, or adding audio feedback suppression in the signal path, etc.

In an embodiment of the invention, said method comprises a step of automatically suppressing said detected audio feedback. When audio feedback has been detected by the present invention, it may advantageously be suppressed automatically. In preferred embodiments, the frequency of the audio feedback can be found during the process of detection, and suppression filters can then be targeted to the detected audio feedback frequency. In an embodiment of the invention, said step of suppressing said audio feedback comprises attenuating an output audio signal based on said input audio signal. Simply turning down the volume of the output signal automatically, may often remove audio feedback and reduce the risk of feedback building up again. In an embodiment of the invention, said step of suppressing said audio feedback comprises applying at least one audio feedback suppression filter. In an embodiment of the invention, said at least one audio feedback suppression filter has a filter center frequency approximately equal to an audio feedback frequency of said audio feedback. As audio feedback by nature is very narrow-banded, audio feedback may often be effectively and automatically removed by application of one or more audio feedback suppression filters targeting the frequencies of the audio feedback.

In an embodiment of the invention, said audio feedback frequency is determined on the basis of said energy level difference by a difference-to-frequency mapping function. As mentioned above, there is a quite reliable relationship between frequency and energy level difference when the input audio signal includes a prominent tone, which is the case when audio feedback is present, and when the audio feedback frequency is between the center frequencies of two analysis audio filters. Hence, a difference-to-frequency mapping function based on this relationship may advantageously be used to identify the audio feedback frequency.

In an embodiment of the invention, said at least one suppression filter is a notch filter. A notch filter has the advantage of only dampening a narrow frequency band, thus suppressing for example audio feedback, while at the same time leaving as much of the original signal intact. It is understood that the suppression filter according to the invention is not limited to a specific type of filter. Thus, according to embodiments of the invention, the suppression filters may comprise notch filters or double precision peaking filters, and/or other suppression filter types. In an exemplary embodiment of the invention, one or more suppression filters are implemented as band rejection filters. In an embodiment of the invention, said at least one suppression filter is a parametric equalizer filter implemented as a band stop filter. Parametric equalizer filters are bandpass or band stop filters characterized by their gain, center frequency and quality factor. In an embodiment, the audio feedback suppression filters are implemented as double precision parametric equalizer filters with a center frequency at the audio feedback frequency and a relatively large quality factor to achieve a narrow rejection band filter. In an embodiment of the invention, said at least one suppression filter has a quality factor Q of 10 or higher.

In an embodiment of the invention, Q may for example be around 16 which for many applications provides a suitable precision of the suppression band. Other embodiment may have Q higher than 15, such as 16, 17, 18 or even higher, such as 20, 25 or 30. Other embodiments may have Q higher than 5 or 10, such as within the range of 5-26, e.g., 12 or 14. It may be an advantage to use a suppression filter with a Q=16, to ensure the suppression filter has a suitably narrow frequency band to ensure the suppression filter predominantly dampens the feedback frequency, while keeping other parts of the audio signal undistorted. In further embodiments of the invention it may be preferred to apply one or more suppression filters with a Q above 16, to narrow the frequency band of the suppression filter even further. In an exemplary embodiment, it may be preferred to configure one or more suppression filters with a Q below 16, to broaden the frequency band of the suppression filter. This may be particularly useful if the precision of the feedback detection is low. This may for example occur at low signal-to-noise ratios. In an embodiment of the invention, said at least one suppression filter has a gain of −3 dB or lower. One or more suppression filters may have a gain of for example −6 dB, i.e., reduce the signal by 6 dB at the suppression filter frequency. This may also be referred as an attenuation of 6 dB. In various embodiments the gain of at least one suppression filter is −4 dB or lower, such as −5 dB, −6 dB, −7 dB, or even lower such as −9 dB, −12 dB or −20 dB, such as within the range of −1 to −20 dB or −30 dB.

In an embodiment of the invention, said step of suppressing said audio feedback comprises applying at least two cascaded audio feedback suppression filters. By cascading, e.g., series coupling, several audio feedback suppression filters, several audio feedback frequencies may be suppressed if some of the cascaded filters are configured with different center frequencies, and/or an audio feedback frequency may undergo accumulated suppression by cascading several filters with the same center frequency. For example, 4 audio feedback suppression filters all being double precision parametric equalizer rejection filters with Q=16 and gain of −6 dB, and respective center frequencies of 151 Hz, 151 Hz, 417 Hz and 2276 Hz, may provide a combined rejection of audio feedback at 151 Hz by 12 dB, at 417 Hz by 6 dB and at 2276 Hz by 6 dB. This principle may be applied for any center frequencies and any number of filters.

In an embodiment of the invention, said step of suppressing said audio feedback comprises processing said input audio signal by a filter bank of audio feedback suppression filters to establish an output audio signal. An example of a filter bank which may be advantageous is a bank of 16 double precision parametric equalizer rejection filters each with Q=16 and gain of −6 dB, where the filters can be cascaded to achieve the filter combination effect described above to for example cause selectable rejection at 6 dB, 12 dB or 18 dB, and at different frequencies according to the audio feedback detected by the invention. The filters of the filter bank may preferably be coupled in and out softly, e.g., by means of a multiplexer with slew, to avoid pops and clicks in the output audio signal. In an embodiment of the invention, said method comprises updating said audio feedback suppression filters based on a history of levels at different audio feedback frequencies. In a preferred embodiment, when all available audio feedback suppression filters are already employed for suppression of audio feedback frequencies, and a new audio feedback is detected, a history of audio feedback levels at the different audio feedback frequencies may advantageously be used to determine the least important audio feedback suppression filter in use, and update that filter to reject the newly detected audio feedback.

In an embodiment of the invention, filter coefficients of said audio feedback suppression filter are determined by a difference-to-filter-coefficient-mapping function, wherein said difference-to-filter-coefficient-mapping function maps an energy level difference for a detected audio feedback to filter coefficients, such that a center frequency of said at least one suppression filter is substantially equal to the frequency of said detected audio feedback. In an embodiment, the energy level difference may be mapped directly to suppression filter coefficients, instead of first determining the audio feedback frequency. As there exists a relationship between feedback frequency and energy level difference, and between feedback frequency and suppression filter coefficients, the feedback frequency can be removed from the calculation, and filter coefficients calculated or looked up directly from the energy level difference. In some embodiments this may save runtime processing, for example by having a lookup table of pre-calculated filter coefficients.

In an embodiment of the invention, said plurality of analysis audio filters comprises 3, 4, 5, 6 or more different analysis audio filters. The different analysis audio filters may have different center frequencies distributed over the frequency range where audio feedback detection is desired, for example to cover the frequency band from 40 Hz to 15.5 kHz. In a preferred embodiment, 5 different analysis audio filters are employed, all 5 being double precision peaking filters with center frequencies of 40 Hz, 200 Hz, 1000 Hz, 5000 Hz and 15500 Hz, respectively. The first four filters preferably have quality factors of 2 to provide relatively broad band filters, whereas the fifth filter at 15500 Hz may have a higher quality factor of for example 5, as the ratio between the fourth and fifth filter is less than between the other filters. In an embodiment with the above filter distribution, the difference between the level of attenuation of two neighboring analysis audio filters may be achieved to vary between 20 dB and −20 dB, i.e., a range of 40 dB difference over a frequency range of e.g. 200 Hz-1000 Hz or 1000 Hz-5000 Hz. Advantageously, this may give audio feedback detection with a suitable precision to determine the frequency of the audio feedback if desired. In an embodiment of the invention, each analysis audio filter of said plurality of analysis audio filters have a different filter center frequency. In an embodiment of the invention, each analysis audio filter of said plurality of analysis audio filters have different filter coefficients.

For a bandpass filter, the filter center frequency may for example be understood as the frequency of the center of the bandpass filter and/or the frequency at which the attenuation/gain of the filter has an extrema point. For low-pass and high-pass filters, the filter center frequency may for example be understood as the cutoff frequency of that filter. A cutoff frequency may for example be defined as the frequency at which the filter attenuates an input signal by 3 dB. Using different filters with different filter center frequency and or different filter coefficients allows the analysis to be tailored further, which is advantageous. For example, an optimal frequency range may be increased, or the precision or accuracy may be improved. In an embodiment of the invention, a frequency ratio of said filter center frequency of at least one separate analysis audio filter of said plurality of separate analysis audio filters and said filter center frequency of at least another separate analysis audio filter of said plurality of separate analysis audio filters is from 1.001 to 1000, for example from 1.01 to 100, for example from 1.02 to 50, for example from 1.05 to 20, for example 1.1 to 10, such as for example 1.2 to 5. In an exemplary embodiment of the invention, a first analysis audio filter has a filter center frequency of 40 Hz, and a second analysis audio filter has a filter center frequency of 200 Hz. The frequency ratio is thus 5. Having a specified frequency ratio of the filter center frequencies of the analysis audio filters may provide a certain optimal frequency range for the method, which is advantageous. Alternatively, in some embodiments of the invention, the first and the second analysis audio filters have the same filter center frequency, but different quality factors Q. In a further exemplary embodiment of the invention, an additional third analysis audio filter has a filter center frequency of 1000 Hz, a fourth analysis audio filter has a center frequency of 5000 Hz and a fifth analysis audio filter has a center frequency of 15500 Hz, causing a frequency ratio between the third and fourth filter of 5, and between the fourth and fifth filter of 3.1. In an embodiment of the invention, a quality factor Q of at least one analysis audio filter of said plurality of analysis audio filters is from 0.01 to 100, for example from 0.1 to 10, such as 2 or 5. In some embodiments of the invention, the analysis audio filters may have a quality factor of 2 or around 2. However, in other embodiments of the invention, it may be preferred that at least one analysis audio filter has a higher quality factor, for example 5 or around 5. The quality factor may determine the sensitivity and precision with which a given audio feedback may be detected. It may therefore be advantageous to adapt the filter quality factor so that the difference between the attenuation of two filters with overlapping frequency bands are large at the frequencies where audio feedback is expected to occur.

In an embodiment of the invention, at least one analysis audio filter of said plurality of analysis audio filters is a bandpass filter. Two or more, such as three or more, such as four or more, such as all said analysis audio filters may also be bandpass filters. In an embodiment of the invention, at least one analysis audio filter of said plurality of analysis audio filters is a double precision peaking filter. In a preferred embodiment of the invention, the analysis audio filters are double precision peaking filters. In a further embodiment at least one analysis audio filter is a double precision peaking filter. In an embodiment of the invention, at least one analysis audio filter of said plurality of analysis audio filters is a high-pass filter. In an embodiment of the invention, at least one analysis audio filter of said plurality of analysis audio filters is a low-pass filter. In some embodiments of the invention, one of said plurality of analysis audio filters may be a bandpass filter, whereas at least one of the other of said plurality of analysis audio filters may be high-pass or a low-pass filter. In an embodiment of the invention, at least one analysis audio filter of said plurality of analysis audio filters is an all-pass filter. In some embodiments of the invention, one analysis audio filter is an all-pass filter. An all-pass filter may be understood as a filter which applies a frequency dependent phase shift. In embodiments with an all-pass filter, the comparison of the at least two filtered audio signals may thus involve estimating a relative phase shift between the two filtered audio signals, and accordingly, the energy level difference is indicative of this relative phase shift. In an embodiment of the invention, a lowest filter center frequency of an analysis audio filter of said plurality of analysis audio filters is from 0 to 100 Hz. It may be advantageous that a lowest filter center frequency of an analysis audio filter is below 100 Hz, to detect audio feedback in the frequency band above and below 100 Hz or to measure subharmonics of a fundamental frequency at or below or above 100 Hz. Audio feedback typically lacks harmonic or subharmonic frequencies or have subharmonic or harmonic content with substantially lower energy level compared to for example audio produced by musical instruments. In an advanced embodiment of the invention, measuring subharmonic content may thus provide a further means of validating a detected audio feedback as actual feedback, based on subharmonic and subharmonic content. In an embodiment of the invention, a highest filter center frequency of an analysis audio filter of said plurality of analysis audio filters is from 10000 to 50000 Hz. It may be advantageous to include an analysis audio filter with a filter center frequency in the range of 10000 Hz to 50000 Hz to be able to detect harmonics of fundamental frequencies. The presence of harmonics may be applied in a further analysis step, to separate actual feedback from non-feedback frequency content of the audio signal.

In an embodiment of the invention, said step of obtaining said energy level difference comprises subtracting at least two of said plurality of filtered audio signals. In an embodiment of the invention, said step of obtaining said energy level difference comprises calculating a ratio between at least two of said plurality of filtered audio signals. In an embodiment of the invention, said method comprises a step of measuring a signal energy level for each of said at least two filtered audio signals, to obtain at least two separate signal energy levels. Measuring a filtered audio signal to detect its energy level is a straightforward approach to determine the energy level and is thus advantageous due to simplicity. Such a measurement may for example be performed by a separate process or unit, for example a level detector. A measurement may also be performed as an integrated part of comparing at least two filtered audio signals of said plurality of filtered audio signals to obtain an energy level difference. In an embodiment of the invention, said step of obtaining said energy level difference is based on two neighboring analysis audio filters with highest filtered audio signal energy levels.

In an embodiment, it is determined between which two analysis audio filters the audio feedback is present, by selecting the two neighboring analysis audio filters with highest output levels when applying the input audio signal. Then the difference between these two levels are used as energy level difference for the further method steps. Analysis audio filters are considered neighboring filters when adjacent in a filter list ordered by peak frequency.

In an embodiment of the invention, said step of obtaining said energy level difference comprises comparing at least two of said at least two separate signal energy levels to obtain at least one tentative energy level difference, wherein said energy level difference is based on at least one tentative energy level difference of said at least one tentative energy level difference. It may be preferred to compare individual filtered audio signals from at least two analysis audio filters to obtain a tentative energy level difference corresponding to the frequency band covered by the two analysis audio filters. Embodiments of the invention may comprise several analysis audio filters, as described above, wherein each pair of audio filters may cover separate frequency bands. In such examples of embodiments of the invention, it may be preferred to obtain a tentative energy level difference for each pair of analysis audio filters that covers a different frequency band. Then, each of these tentative energy level differences representing different frequency bands may be evaluated to determine which of the tentative energy level differences that represents a prominent tone, i.e. an audio feedback, of the audio input signal. In an exemplary embodiment of the invention having two analysis audio filters, the energy level difference may be equal to the tentative energy level difference. Subtraction and calculation of a ratio are two exemplary approaches to compare energy levels, which are advantageous due to their simplicity In an embodiment of the invention, said method further comprises a step of converting said energy level difference by a difference-to-frequency mapping function into an audio feedback frequency of the detected audio feedback. A difference-to-frequency mapping function may be understood as a physical or digital unit which is able to participate in converting the energy level difference into a corresponding representation of the audio feedback frequency. In various embodiments of the invention, due to different analysis audio filters, the energy level difference depends on the frequency of the audio feedback, at least in some frequency range. This dependency may be contained in the difference-to-frequency mapping function. The difference-to-frequency mapping function may thus for example be a lookup table of a piecewise mathematical function. It may for example be implemented in a frequency mapping unit. In some embodiments of the invention, a difference-to-frequency mapping function may have several energy level differences as inputs, for example an energy level difference from a first and a second filtered audio signal, and an energy level difference from the second and a third filtered audio signal. In an embodiment of the invention, said difference-to-frequency mapping function is a lookup table. In an embodiment of the invention, said difference-to-frequency mapping function is a mathematical function. Both a lookup table and a mathematical function are easy to implement and require limited computational power, which is advantageous. Other difference-to-frequency mapping functions, for example a second or a third difference-to-frequency mapping function, may also, for example, be based on lookup tables and/or mathematical functions. A mathematical function may for example be a linear function or a non-linear function. It may be a piecewise mathematical function.

In an embodiment of the invention, said method comprises a step of converting said energy level difference by a difference-to-filter mapping function into filter coefficients for a band rejection or band pass filter of a corresponding frequency. As the energy level difference is translatable into frequency, the energy level difference may also in an embodiment be directly used to calculate or look-up filter coefficients, filter parameters or other filter characterizations, thereby enabling direct adaptation of for example audio feedback suppression filters or harmonic detection filters based on the energy level difference, instead of going through an intermediate step of convert to frequency and then converting from frequency to filter. In other embodiments the frequency is used for several purposes, making it less beneficial to avoid determining it from the energy level difference.

In an embodiment of the invention, said detecting said audio feedback comprises determining presence of audio feedback when at least two subsequent energy level differences of said plurality of energy level differences are approximately equal. As described above, in order to validate that an established energy level difference represents an audio feedback and not music, speech or noise, etc., the energy level differences from several, such as at least two, preferably three, consecutive repetitions of the analysis step and filtered audio signal comparison step, are compared. When approximately similar energy level differences, i.e., approximately equal, are detected across for example two or three repetitions, it is determined that audio feedback is present in the input audio signal. As mentioned above, this is also referred to as sustain detection, i.e., determining whether the input audio signal contains a sustained, prominent tone, which could likely come from audio feedback. In an embodiment of the invention, said method comprises a step of updating a sustain state based on said comparing at least two energy level differences from at least two of said repetitions, wherein said sustain state is indicative of a sustained tone in said input audio signal. In an embodiment a sustain state is continuously updated based on the difference between recent energy level differences, so that the sustain state indicates whether a sustained tone is present in the signal, e.g., by storing a value of true or false, or by storing the value of the energy level difference if sustain is detected, for further reference in subsequent stages, e.g., difference-to-frequency mapping, etc. In an embodiment of the invention, said method comprises a step of updating an audio feedback state based on said sustain state or said comparing at least two energy level differences from at least two of said repetitions, wherein said audio feedback state is indicative of an audio feedback in said input audio signal. In an embodiment an audio feedback state is continuously updated based on either the sustain state as described above or the difference between recent energy level differences. In the former case where a sustain state is updated and indicative of the presence of a sustained tone, a feedback validator may use this as input, optionally together with other input, to determine whether an audio feedback is thereby present.

Without other input, the feedback state preferably equals the sustain state. Other input options to validate this determination are described below, for example harmonic detection, reducing amplitude detection, etc. In the latter case, where the feedback state is determined directly from the comparison of consecutive energy difference levels, the audio feedback state is determined as described for the sustain state above, and it becomes unnecessary to update two identical states. In both cases, the audio feedback state indicates whether an audio feedback is present in the signal, e.g. by storing a value of true or false, or by storing the value of the energy level difference if audio feedback is detected, for further reference in subsequent stages, e.g., difference-to-frequency mapping, etc. In an embodiment of the invention, said sustain state or said audio feedback state is updated at an interval in the range of 5 ms to 500 ms, such as 50 ms.

To determine that a tone is sustained, i.e., persists for a prolonged time, it is necessary to wait a reasonable amount of time before evaluating a new energy level difference for comparison. Otherwise, even desired content of the input audio signal such as music, speech, etc., might not have changed sufficiently to produce a different energy level difference, and therefore might be mistaken as a sustained tone. On the other hand, the interval between sustain evaluations should be sufficiently short for the automatic audio feedback detection to be able to detect and optionally suppress the audio feedback before it gets too disturbing or damages equipment. In preferred embodiments, the interval between sustain or feedback evaluations may be between 1 ms and 1 s, such as between 10 ms and 100 ms, for example 25, 40, 50 60, 75 or 80 ms. The evaluation and updating at these intervals may in a preferred embodiment be based on an envelope of a stream of energy level difference changes below a threshold, as described below, at each of said intervals for a consecutive 2 or 3 or more intervals to cause a change of sustain state and/or audio feedback state.

In an embodiment of the invention, said step of comparing at least two energy level differences of said plurality of energy level differences obtained from at least two of said repetitions comprises determining at least one energy level difference change. In an embodiment of the invention, said at least one energy level difference change is a representation of a mathematical relationship, such as subtraction or a ratio, between said at least two of said plurality of energy level differences obtained from at least two of said repetitions.

According to an embodiment of the invention, detecting audio feedback comprises determining whether a tone is sustained by calculating an energy level difference change between repetitions of the method. The energy level difference change may in an embodiment be calculated as a difference between at least two energy level differences. It is understood that this difference may be an absolute difference. In an embodiment the energy level difference change may be calculated as a ratio, factor or percentage of change. Subtraction and calculation of a ratio are two exemplary approaches to compare energy level differences, which are advantageous due to their simplicity. An energy level difference change of approximately zero for a subtraction approach or approximately one for a ratio approach is indicative of a tone being sustained between at least two repetitions or sustain evaluations, i.e., for example for 50 ms. The energy level difference change may be monitored even longer, i.e., for further evaluations, to detect a sustained tone, e.g., for 3 or 4 evaluations, which corresponds to 100 ms or 150 ms in an embodiment with 50 ms interval between evaluations. In an embodiment of the invention, a difference change envelope is calculated based on one or more consecutive of said determined at least one energy level difference change. Based on an envelope of the stream of energy level difference changes, it may be relatively simple to determine when the energy level differences stay around e.g., zero for an embodiment with subtraction-approach, thereby being indicative of a sustained tone.

In an embodiment of the invention, at least one energy level difference change is at least two energy level difference changes, such as for example at least three energy level difference changes. In an embodiment of the invention, two energy level difference changes are compared to detect audio feedback in an input audio signal. In a further embodiment of the invention, it may be advantageous to monitor three or more consecutive energy level difference changes to detect audio feedback, as audio feedback stays substantially constant over time, whereas musical content of an audio signal typically varies significantly over short time periods. According to an embodiment of the invention, feedback is detected when at least one energy level difference change is approximately zero. In another embodiment of the invention, feedback is detected when at least 2, 3 or 4 or more energy level difference changes are approximately equal. Including more energy level difference changes in the feedback detection may advantageously decrease the error rate of feedback detection. In an embodiment of the invention, said detecting said audio feedback comprises determining presence of audio feedback when said at least one energy level difference change is below an energy level difference change threshold. In an embodiment of the invention, said energy level difference change threshold is predetermined. It may be an advantage to utilize a threshold to determine when an energy level difference change is sufficiently small to be indicative of the presence of a sustained tone or audio feedback. Such an energy level difference change threshold may be dependent on the method with which the energy level difference change is determined. An energy level difference change threshold in a subtraction-based embodiment may for example be 2 dB, 1 dB, 0.8 dB, 0.5 dB or 0.3 dB, or in a ratio-based embodiment may for example be between 0.8 and 1.2, 0.9 and 1.1, 0.95 and 1.05, 0.98 and 1.02, or 0.99 and 1.01.

In an embodiment of the invention, said method comprises a step of threshold detection to determine that audio feedback is not present when a magnitude of a digital representation of said input audio signal does not exceed −40 dBFS. As audio feedback is characterized by quickly building up a high level, it is advantageous to only apply a feedback detection method above a certain energy level. To avoid unnecessary processing and/or quickly determine when audio feedback is not possible in the input audio signal, it may be advantageous to apply an input level threshold before performing the steps of analyzing and comparing, and only proceed with the rest of the method when the digitized input audio signal level is a certain level. A suitable threshold may be −40 dBFS. In other embodiments, the threshold may be set at −60 dBFS, −50 dBFS, −30 dBFS, −20 dBFS.

In an embodiment of the invention, said method comprises a step of filtering said input audio signal with at least one noise filter before said step of separately filtering said audio input signal with said plurality of separate analysis audio filters. In an embodiment of the invention, said at least one noise filter is an adaptive filter. In an embodiment of the invention, said at least one noise filter comprises at least two adaptive filters in a line enhancer configuration. It may be an advantage to apply a noise filter to reduce non-periodic content of said input audio signal before providing the signal to the analysis audio filters, as this may improve the precision of feedback detection. It may further be advantageous to apply at least one adaptive filter, or alternatively, one noise filter comprising two adaptive filters in a line enhancer configuration. Periodic detection using such noise filters may increase the signal to noise ratio. In an example the signal-to-noise ratio may be increase from for example 10 dB to 50 dB. The effect may depend on frequency of the filtered signal. Improving the signal-to-noise ratio may result in a more sensitive and more precise feedback detection. In an embodiment of the invention, the aforementioned one or more noise filters, for example adaptive filters or non-adaptive filters, may be fed a current signal and a delayed signal. Including the delayed signal in the filtering step may improve the removal of non-periodic content by the adaptive filter, thereby it may further improve signal-to-noise ratio of the filtered audio input signal. It is understood that the term noise filters may refer to any form of filter or filters configured to reduce non-periodic content in an audio signal.

In an embodiment of the invention, said method comprises a step of boundary detection to validate said detection of audio feedback based on two or more consecutive energy level difference changes.

The above-described procedure, of sustain detection by evaluating several energy level difference changes at predetermined intervals to improve the reliability of the audio feedback detection, may in certain embodiments be prone to an irregularity under certain circumstances, in which case it may be advantageous to provide a boundary detection feature to validate when these circumstances are present. Embodiments with three or more analysis audio filters are prone to this irregularity, as the system then need to decide from which two adjacent filters the outputs should be compared to detect the presence of audio feedback. The more prominent the tone, the more reliably an energy level difference represents the frequency of that tone, e.g. the frequency of audio feedback. Though, when this frequency happens to coincide with a peak of an analysis audio filter that lies between two other analysis audio filters, or close to such peak, for example within a frequency range of +/−2% relative to such peak, the determination of whether the tone is sustained is more prone to errors, especially in the presence of noise. As the energy level difference varies due to the other signal content, e.g., noise, even if a prominent and constant audio feedback is present in the input audio signal, the frequency associated with the energy level difference may shift back and forth each side of a filter peak frequency, and thereby continuously change which two analysis audio filters are compared to determine the energy level difference for further evaluation, whereby also the energy level difference changes and the subsequently calculated envelope may become too unstable to stay below the threshold that is set for reliably determining an audio feedback, leading to audio feedback being detected slower or not at all at the frequencies coinciding with the analysis audio filter center frequencies. A feature of boundary detection may be implemented, which monitors when audio feedback candidate energy level differences coincide with or are close to the analysis audio filter center frequencies. According to an embodiment of the invention, the boundary detection frequency check may determine when a problematic energy level difference is detected, and for example lock the comparison of filtered audio signal energy levels to a certain pair of analysis audio filters, or momentarily disable the sustain detection. As an example, in an embodiment of the invention configured with five analysis audio filters having peak frequencies at for example 40 Hz, 200 Hz, 1000 Hz 5000 Hz and 15500 Hz, respectively, the problematic boundary frequencies are at 200, 1000 and 5000 Hz.

In an embodiment of the invention, said method comprises a step of validating said audio feedback based on detecting lack of harmonic content of said audio feedback in said input audio signal. It is understood that harmonic content refers to any harmonics or subharmonics of a tone. In general, audio feedback is characterized by a lack of harmonic content relative to the fundamental frequency of the audio feedback. In comparison, most musical instruments and voices produce a large degree of harmonics. Therefore, it may be advantageous to detect lack of harmonic content of a prominent tone, to validate whether an identified prominent tone is audio feedback or for example more probably if harmonics are present, a sustained musical note. In an embodiment of the invention, said detecting lack of harmonic content is performed at predetermined intervals. In an embodiment of the invention, said predetermined interval is 50 ms. In an exemplary embodiment according to the invention, lack of harmonic components of an audio feedback is monitored at predetermined intervals, for example every 100 ms, such as every 70 ms, for example preferably every 50 ms, such as every 40 ms, such as every 30 ms, such as every 20 ms, such as every 10 ms. In a further exemplary embodiment according to the invention, lack of harmonic components is monitored every $100^{th}$ to $5^{th}$ millisecond. In an embodiment of the invention, said detecting lack of harmonic content comprises determining when at least one harmonic energy level is below a predetermined harmonic energy level threshold. In an embodiment of the invention, said detecting lack of harmonic content comprises determining when said at least one harmonic energy level is below said predetermined harmonic energy level threshold for at least two out of three consecutive predetermined intervals. In an embodiment of the invention, said harmonic energy threshold as compared with an energy level of said prominent tone is −20 dB, such as −30 dB, such as −40 dB, such as −50 dB, such as −60 dB.

Lack of harmonic content may preferably be determined as a low signal level at the harmonics frequencies of the prominent tone that is being evaluated for audio feedback. By low signal level may for example be referred to 30 dB lower than the prominent tone level. In a preferred embodiment, a predetermined threshold is used to evaluate whether harmonic content exists, by comparing the signal level at the harmonics frequencies with the predetermined threshold, e.g., −30 dB. In an embodiment of the invention, said harmonic content comprises one or more selected from the list of a first harmonic, a second harmonic, a third harmonic and a subharmonic of said prominent tone. Advantageously, a lack of these harmonics and/or subharmonics may be a good predictor of audio feedback. As different musical instruments and voices generate different harmonics, which is in fact why they have so different timbre, it is advantageous to test several harmonics, and not only, for example, the first harmonic. In an embodiment of the invention, said step of detecting lack of harmonic content comprises a step of filtering said input audio signal with harmonic filters centred at harmonic frequencies of said prominent tone to obtain at least one harmonic detection signal. In an embodiment of the invention, an energy level of said at least one harmonic detection signal is compared with an energy level of said prominent tone to obtain at least one harmonic energy level. In an embodiment of the invention, filter coefficients of said at least one harmonic filter is determined based on said energy level difference. In an embodiment of the invention, filter coefficients of said at least one harmonic filter is determined based on said audio feedback frequency of said audio feedback. In an embodiment of the invention, said at least one harmonic filter is a narrow band pass filter, such as a double precision peaking filter with a quality factor of 64.

In an embodiment of the invention, said method comprises a step of validating said audio feedback based on detecting when an energy level of said audio feedback is approximately constant or increasing between two or more consecutive said repetitions. As desired sound, such as music, may comprise sustained tones, a further validation of audio feedback may advantageously be applied in a preferred embodiment. By monitoring the level of the prominent tone that is being evaluated as an audio feedback candidate, the tone may be validated as being considered undesired audio feedback if the level stays the same or increases. On the other hand, if the amplitude is reducing, the tone is considered a desired, sustained tone, and feedback suppression is not applied.

In an embodiment of the invention, said method comprises a step of validating said audio feedback based on detecting an energy level at an audio feedback frequency of said audio feedback exceeding a predetermined feedback intensity threshold. By only validating a feedback candidate as actual audio feedback for which audio feedback suppression may be applied when its level exceeds a feedback intensity threshold, it may further increase the reliability of not erroneously mistake desired, sustained musical tones at lower levels for audio feedback, and it may further be avoided to spend filtering power on low level feedback which may not be disturbing or even discernible. The feedback intensity threshold may for example be selected as a level at which feedback gets audible or disturbing.

In an embodiment of the invention, said method comprises a step of applying audio feedback suppression when a clip detection determines a signal level exceeding a clipping threshold. In an embodiment, a clip detection monitor the output audio signal provided to subsequent stages including an amplifier. The clip detection determines when the signal level is sufficiently high to risk that clipping occurs in the transducer, such as a loudspeaker. In that case the audio feedback suppression is immediately applied. Even in embodiments comprising harmonics detections and/or reducing amplitude detection, these measures are disabled because they require a significant amount of time, such as for example waiting for three intervals of 50 ms. The clip detection and immediate activation of feedback suppression may be advantageous because clipping of the transducer may result in audio feedback with harmonic content, which may be picked up by the microphone and generate even more audio feedback. Therefore, in such a case, and in order to still be able to suppress the feedback, the harmonic detector and the reducing amplitude detector may preferably be disabled and feedback suppression activated.

In an alternative aspect is disclosed a method for automatically detecting audio feedback in an input audio signal. The method comprises the steps of separately filtering the audio input signal with a plurality of separate analysis audio filters to generate a plurality of filtered audio signals; wherein the separate analysis audio filters are different. Further, comparing at least two filtered audio signals of said plurality of filtered audio signals to obtain an energy level difference. Further comparing at least two of the obtained energy level differences to detect said audio feedback. Further applying audio feedback suppression to said input audio signal to establish an output audio signal, wherein the audio feedback suppression is configured on the basis of said detection of audio feedback. In this aspect, any of the features described above may be applied for further enhancement and configuration.

An aspect of the invention relates to an audio processing system for detecting audio feedback of an input audio signal, said audio processing system comprising: an audio signal input for receiving said input audio signal; a plurality of analysis audio filtering units communicatively connected to said audio signal input for separately filtering said input audio signal; at least one filtered audio signal comparator unit communicatively connected to at least two analysis audio filtering units of said plurality of analysis audio filtering units, wherein an output of said at least one filtered audio signal comparator is an energy level difference based on input from said at least two analysis audio filtering units; and a feedback detector unit communicatively connected to said output of said at least one filtered audio signal comparator, wherein said feedback detector unit is arranged to detect when a value of said output of said at least one filtered audio signal comparator is constant and thereby generate and provide feedback information. An audio signal input may be any type of input, e.g., based on a wired connection, a wireless connection, a microphone, or a data storage for providing the input audio signal. As such, the audio signal input does not necessarily have a physical connector.

The plurality of analysis audio filtering units may for example separately filter the input audio signal to generate a plurality of filtered audio signals, of which two of these are used as input for a filtered audio signal comparator unit.

In an embodiment of the invention, said at least one filtered audio signal comparator unit is communicatively connected to said at least two analysis audio filtering units through separate energy detectors. For example, a separate energy level detector may be located after each of the two analysis audio filtering units, or after each analysis audio filtering unit of the plurality of analysis audio filtering units. For example, such that each of the at least one filtered audio signal comparator units is connected to analysis audio filtering units through separate level detectors. In an embodiment of the invention, said at least one filtered audio signal comparator unit is a plurality of filtered audio signal comparator units, wherein each filtered audio signal comparator unit of said plurality of filtered audio signal comparator units is communicatively connected to at least two respective analysis audio filtering units of said plurality of analysis audio filtering units, wherein said feedback information is based on one or more respective outputs of respective filtered audio signal comparator units of said plurality of filtered audio signal comparator units. In embodiments with more than one filtered audio signal comparator unit, each filtered audio signal comparator unit, each comparator unit may be connected to two analysis audio filtering units, such that each comparator unit is connected to a unique combination of analysis audio filtering units. Thus, multiple energy level comparisons may be performed, e.g. to establish multiple energy level differences. And the feedback detection may be based on selecting one of these energy level differences for further processing, or by processing multiple of these.

In an embodiment of the invention, said feedback detector comprises a sustain detector arranged to compare said energy level difference with a previously established energy level difference. A previously established energy level difference may for example be established in a similar manner as the energy level difference, but at a previous time. For example, an audio signal may have a length of several hundreds of milliseconds, and an energy level difference may be established every 50 milliseconds. In an embodiment of the invention, said feedback detector comprises a feedback state validator arranged to generate said feedback information based on input from said sustain detector. The sustain detector may for example subtract the energy level difference and the previously established energy level difference. The feedback state validator may then for example analyze this result of this subtraction to validate whether audio feedback is present, e.g., if the subtraction is approximately zero.

In an embodiment of the invention, said audio processing system further comprises a feedback suppression unit arranged to implement at least one suppression filter in a communicative connection between an input microphone and an output loudspeaker. In some loudspeaker systems, an output loudspeaker may generate sound based on audio recorded by an input microphone. In such systems, audio feedback may arise, for example if the microphone and the loudspeaker are closely located. Audio feedback may be then be suppressed by implemented at least one suppression filter which the audio recorded by the microphone passes through prior to being emitted as sound by the loudspeaker. In an embodiment of the invention, said input microphone is arranged to provide said input audio signal.

In an embodiment of the invention, a tone detector comprises at least said plurality of analysis audio filtering units and said at least one filtered audio signal comparator unit. In an embodiment of the invention, said tone detector and said feedback detector are implemented on separate units which are communicatively connected. In an embodiment of the invention, said tone detector is implemented on a digital signal processor and said feedback detector are implemented on a system on a chip, wherein said system on a chip is a separate unit from said digital signal processor.

Strategically separating various calculations and/or subunits to separate units as exemplified here may enable selecting cheaper, smaller, or faster electronics to facilitate the system, which is advantageous. An aspect of the invention relates to use of said audio processing system for detecting audio feedback. In an embodiment of the invention, said audio processing system is further used for suppressing said audio feedback by implementing at least one suppression filter. The audio processing system according to embodiments of the invention may be suitable for detecting audio feedback, and optionally for suppressing this feedback, which is advantageous.

LIST OF REFERENCE SIGNS

1 Audio processing system
2 Input audio signal
3 Tone detector
4 Feedback detector unit
5*a-e* Analysis audio filtering unit
6*a-e* Filtered audio signal
7, 7*a-b* Filtered audio signal comparator unit
8, 8*a-b* Energy level difference
9 Sustain detector
10 Sustain state
11 Feedback state validator
12 Feedback information
13 Feedback suppression unit
14 Microphone
15 Loudspeaker
16 Output audio signal
17 Preprocessor
18 Preprocessed audio signal
19*a-c* Energy detector
20 Energy difference to frequency mapping unit
21 Boundary frequency checker
22 Representative tone frequency
23 Periodic detection unit
24 Threshold detector
25*a-b* Preprocessing filters
26*a-e* Frequency representation of energy level attenuation
261*a-b* Frequency representation of energy level attenuation
27 Difference-to-frequency mapping function
28 Harmonics detector
29 Reducing energy level detector
30*a-e* Harmonic filters
31 Harmonics state
32 Reducing energy level state
33 Band detection
34 No audio feedback
35 Energy level difference change
36 Feedback period
37 Audio digital signal processor
38 System on chip
39*a-b* Periodic filter
40*a-b* Delay unit
41 Noise filtered audio signal
42 Absolut determinator
43 Envelope computing unit
44 Energy level difference change threshold comparator
45 Delayed energy level difference
46 Subtraction unit
47 Energy level difference difference
48 Filter bank
49 Filter parameter computing unit
50*a-e* Energy level
51 Processing unit
52 First filtered signal
53 Delayed first filtered signal
54*a-b* Tentative energy level difference
55*a-e* Filter peak frequency
56*a-d* filter frequency range
S1-S4 Method steps

The invention claimed is:

1. A method for automatically detecting audio feedback in an input audio signal, comprising:

separately filtering said audio input signal with a plurality of separate analysis audio filters to generate a plurality of filtered audio signals, said separate analysis audio filters being different and connected in parallel with each other;

comparing at least two filtered audio signals of said plurality of filtered audio signals to obtain an energy level difference;

performing one or more repetitions of said separately filtering said audio input signal and said comparing said filtered audio signals thereby establishing a plurality of said energy level differences; and comparing at least two energy level differences of said plurality of energy level differences obtained from at least two of said repetitions to detect said audio feedback, wherein said comparing at least two energy level differences of said plurality of energy level differences obtained from at least two of said repetitions comprises determining at least one energy level difference change, and wherein said method further comprises performing boundary detection to validate said detection of audio feedback based on two or more consecutive said energy level difference changes.

2. The method according to claim 1, wherein further comprising reproducing, using one or more loudspeakers, an output audio signal based on said input audio signal.

3. The method according to claim 1, further comprising automatically suppressing said detected audio feedback.

4. The method according to claim 3, wherein said suppressing said audio feedback comprises applying at least one audio feedback suppression filter.

5. The method according to claim 3, wherein said suppressing said audio feedback comprises applying at least two cascaded audio feedback suppression filters.

6. The method according to claim 1, further comprising measuring a signal energy level for each of said at least two filtered audio signals, to obtain at least two separate signal energy levels.

7. The method according to claim 6, wherein said comparing said at least two filtered audio signals is based on two neighboring analysis audio filters with highest filtered audio signal energy levels.

8. The method according to claim 1, further comprising converting an energy level difference of said plurality of energy level differences by a difference-to-frequency mapping function into an audio feedback frequency of the detected audio feedback.

9. The method according to claim 1, wherein said detecting said audio feedback comprises determining presence of audio feedback when at least two subsequent energy level differences of said plurality of energy level differences are approximately equal.

10. The method according to claim 1, further comprising updating a sustain state based on said comparing said at least two energy level differences from at least two of said repetitions, wherein said sustain state is indicative of a sustained tone in said input audio signal.

11. The method according to claim 10, further comprising updating an audio feedback state based on said sustain state or said comparing at least two energy level differences from at least two of said repetitions, wherein said audio feedback state is indicative of an audio feedback in said input audio signal.

12. The method according to claim 1, further comprising performing threshold detection to determine that audio feedback is not present when a magnitude of a digital representation of said input audio signal does not exceed −40 dBFS.

13. The method according to claim 1, further comprising filtering said input audio signal with at least one noise filter before said separately filtering said audio input signal with said plurality of separate analysis audio filters.

14. The method according to claim 1, further comprising validating said audio feedback based on detecting lack of harmonic content of said audio feedback in said input audio signal.

15. The method according to claim 1, further comprising validating said audio feedback based on detecting when an energy level of said audio feedback is approximately constant or increasing between two or more consecutive said repetitions.

16. The method according to claim 1, further comprising validating said audio feedback based on detecting an energy level at an audio feedback frequency of said audio feedback exceeding a predetermined feedback intensity threshold.

17. The method according to claim 1, further comprising applying audio feedback suppression when a clip detection determines a signal level exceeding a clipping threshold.

18. An audio processing system for detecting audio feedback of an input audio signal, said audio processing system comprising:

an audio signal input for receiving said input audio signal;

a plurality of analysis audio filtering units communicatively connected to said audio signal input for separately filtering said input audio signal, and said plurality of analysis audio filtering units being connected in parallel with each other;

at least one filtered audio signal comparator unit communicatively connected to at least two analysis audio filtering units of said plurality of analysis audio filtering units, wherein an output of said at least one filtered audio signal comparator is an energy level difference based on input from said at least two analysis audio filtering units; and a feedback detector unit communicatively connected to said output of said at least one filtered audio signal comparator, wherein said feedback detector unit is arranged to detect when a value of said output of said at least one filtered audio signal comparator is constant and thereby generate and provide feedback information, wherein said comparing at least two energy level differences of said plurality of energy level differences obtained from at least two of said repetitions comprises determining at least one energy level difference change, and wherein said method further comprises performing boundary detection to validate said detection of audio feedback based on two or more consecutive said energy level difference changes.

19. The audio processing system as claimed in claim 18, further comprising at least one audio feedback suppression filter for suppressing said detected audio feedback.

* * * * *